United States Patent [19]

Powell

[11] 4,046,228

[45] Sept. 6, 1977

[54] ELEVATOR SYSTEM

[75] Inventor: Bruce A. Powell, Franklin Borough, Pa.

[73] Assignee: Westinghouse Electric Corporation, Pittsburgh, Pa.

[21] Appl. No.: 574,663

[22] Filed: May 5, 1975

[51] Int. Cl.[2] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,589,473 | 6/1971 | Kirsch et al. | 187/29 |
| 3,739,880 | 6/1973 | Robaszkiewicz | 187/29 |
| 3,746,131 | 7/1973 | Hirasawa et al. | 187/29 |
| 3,851,733 | 12/1974 | Sackin et al. | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system, and method of operating same, having a plurality of elevator cars mounted in a building to serve the floors therein. Supervisory system control periodically assigns service directions from the floors to the elevator cars by dividing them among the elevator cars according to a predetermined strategy, it periodically clears certain assignments, and reassigns the cleared assignments. The assignments periodically cleared are those which do not have a registered hall call associated therewith, and those which have a registered hall call but which are behind the advanced position of the car they are assigned to.

11 Claims, 13 Drawing Figures

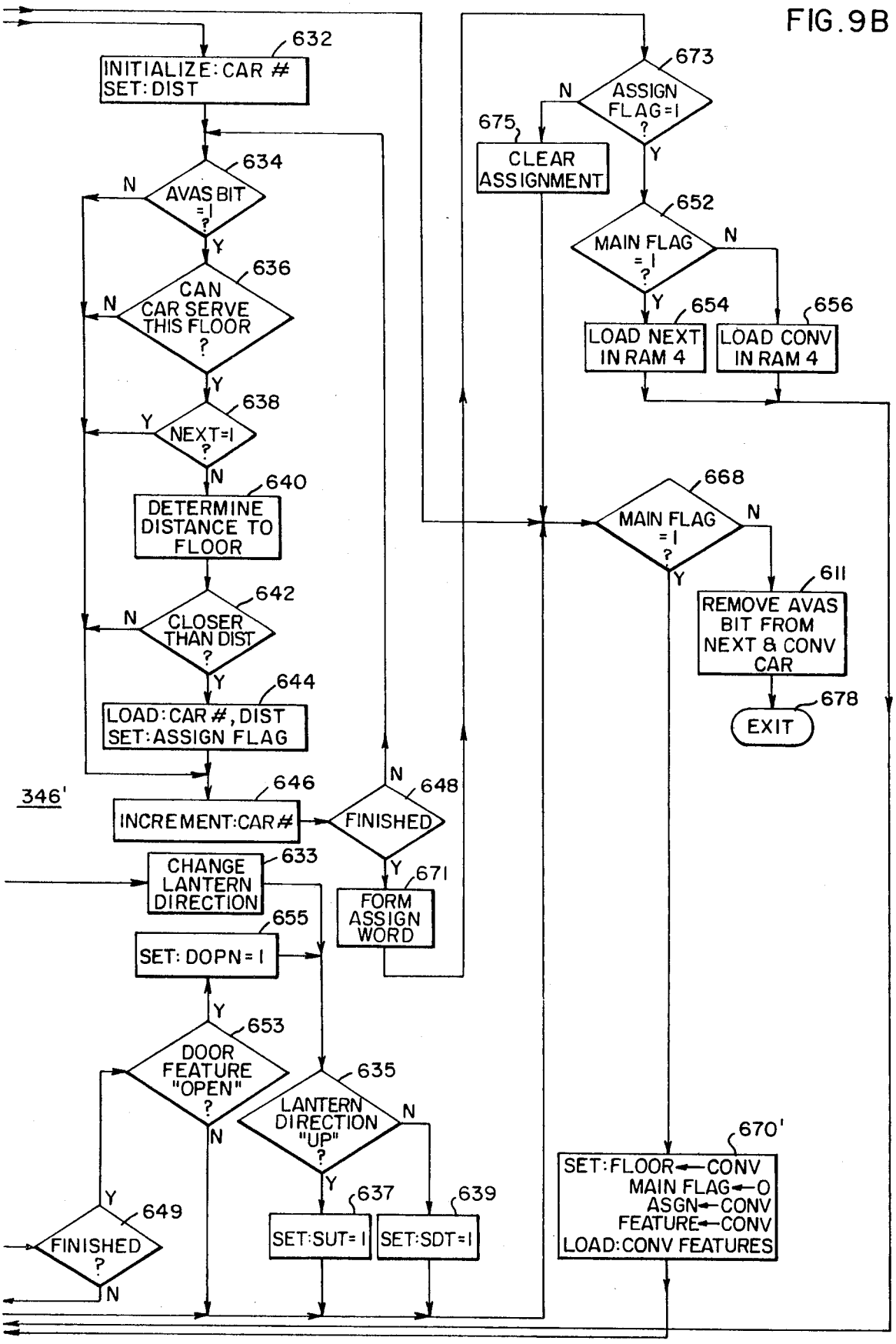
FIG. 9B
632
INITIALIZE: CAR #
SET: DIST
634
AVAS BIT = 1 ?
636
CAN CAR SERVE THIS FLOOR ?
638
NEXT=1 ?
640
DETERMINE DISTANCE TO FLOOR
642
CLOSER THAN DIST ?
644
LOAD: CAR #, DIST
SET: ASSIGN FLAG
346'
646
INCREMENT: CAR #
648
FINISHED
633
CHANGE LANTERN DIRECTION
655
SET: DOPN = 1
653
DOOR FEATURE "OPEN" ?
635
LANTERN DIRECTION "UP" ?
637
SET: SUT = 1
639
SET: SDT = 1
649
FINISHED ?
671
FORM ASSIGN WORD
673
ASSIGN FLAG = 1 ?
675
CLEAR ASSIGNMENT
652
MAIN FLAG = 1 ?
654
LOAD NEXT IN RAM 4
656
LOAD CONV IN RAM 4
668
MAIN FLAG = 1 ?
611
REMOVE AVAS BIT FROM NEXT & CONV CAR
678
EXIT
670'
SET: FLOOR ← CONV
MAIN FLAG ← 0
ASGN ← CONV
FEATURE ← CONV
LOAD: CONV FEATURES
Y
N

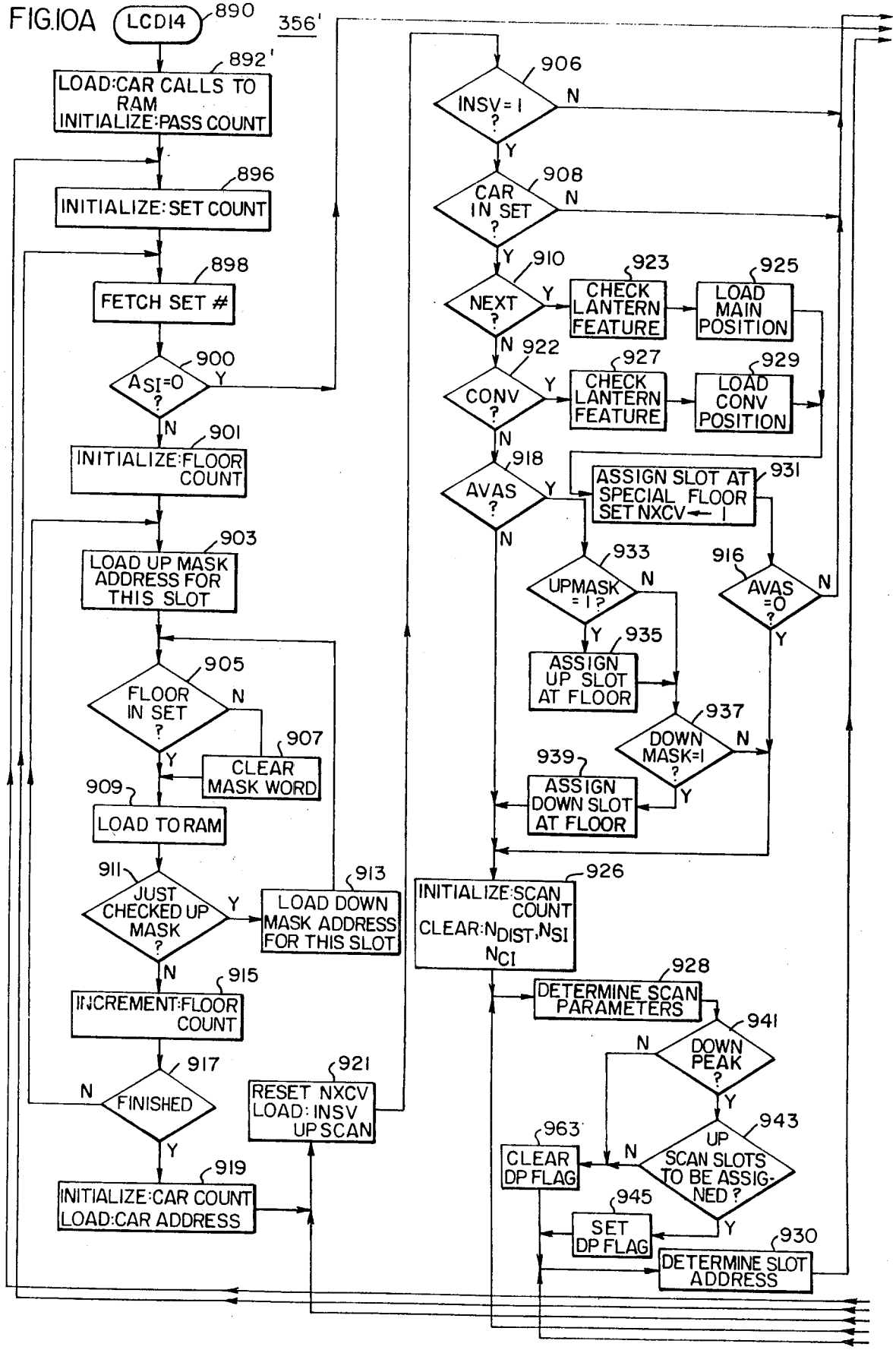
FIG.10A
LCD14
890
356'
892'
LOAD:CAR CALLS TO RAM
INITIALIZE:PASS COUNT
896
INITIALIZE: SET COUNT
898
FETCH SET #
900
ASI=0 ?
Y
N
901
INITIALIZE:FLOOR COUNT
903
LOAD UP MASK ADDRESS FOR THIS SLOT
905
FLOOR IN SET ?
N
Y
907
CLEAR MASK WORD
909
LOAD TO RAM
911
JUST CHECKED UP MASK ?
Y
N
913
LOAD DOWN MASK ADDRESS FOR THIS SLOT
915
INCREMENT:FLOOR COUNT
917
FINISHED
N
Y
921
RESET NXCV
LOAD: INSV
UP SCAN
919
INITIALIZE:CAR COUNT
LOAD:CAR ADDRESS
906
INSV=1 ?
N
Y
908
CAR IN SET ?
N
Y
910
NEXT ?
Y
N
923
CHECK LANTERN FEATURE
925
LOAD MAIN POSITION
922
CONV ?
Y
N
927
CHECK LANTERN FEATURE
929
LOAD CONV POSITION
918
AVAS ?
Y
N
931
ASSIGN SLOT AT SPECIAL FLOOR
SET NXCV ← 1
933
UPMASK =1 ?
N
Y
935
ASSIGN UP SLOT AT FLOOR
916
AVAS =0 ?
N
Y
937
DOWN MASK=1 ?
N
Y
939
ASSIGN DOWN SLOT AT FLOOR
926
INITIALIZE:SCAN COUNT
CLEAR:NDIST,NSI
NCI
928
DETERMINE SCAN PARAMETERS
941
DOWN PEAK ?
N
Y
943
UP SCAN SLOTS TO BE ASSIGNED ?
N
Y
963
CLEAR DP FLAG
945
SET DP FLAG
930
DETERMINE SLOT ADDRESS

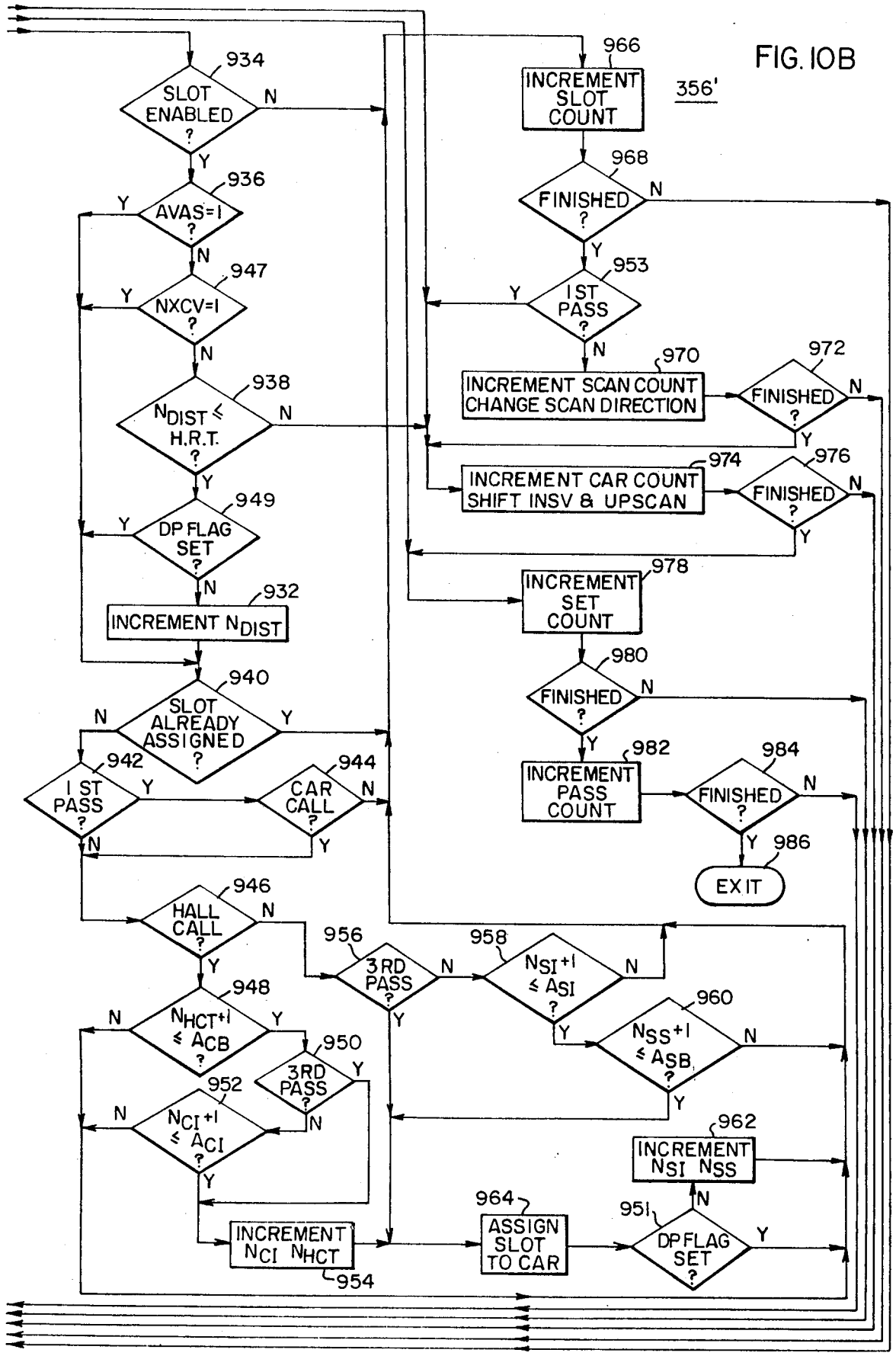
FIG. 10B
356'
934
SLOT ENABLED ?
936
AVAS=1 ?
947
NXCV=1 ?
938
NDIST ≤ H.R.T. ?
949
DP FLAG SET ?
932
INCREMENT NDIST
940
SLOT ALREADY ASSIGNED ?
942
1 ST PASS ?
944
CAR CALL ?
946
HALL CALL ?
948
NHCT+1 ≤ ACB ?
950
3RD PASS ?
952
NCI+1 ≤ ACI ?
954
INCREMENT NCI NHCT
956
3RD PASS ?
958
NSI+1 ≤ ASI ?
960
NSS+1 ≤ ASB ?
962
INCREMENT NSI NSS
964
ASSIGN SLOT TO CAR
951
DP FLAG SET ?
966
INCREMENT SLOT COUNT
968
FINISHED ?
953
1 ST PASS ?
970
INCREMENT SCAN COUNT CHANGE SCAN DIRECTION
972
FINISHED ?
974
INCREMENT CAR COUNT SHIFT INSV & UPSCAN
976
FINISHED ?
978
INCREMENT SET COUNT
980
FINISHED ?
982
INCREMENT PASS COUNT
984
FINISHED ?
986
EXIT

ELEVATOR SYSTEM

CROSS REFERENCE TO RELATED APPLICATIONS

Certain of the apparatus disclosed in this application is claimed in the following concurrently filed applications:

Ser. Nos. 574,767 and 574,766, filed May 5, 1975 in the name of C. L. Winkler, which are assigned to the same assignee as the present application.

BACKGROUND OF THE INVENTION

Copending application Ser. Nos. 503,146, 503,201, and 503,212, filed Sept. 4, 1974, now abandoned and incorporated into Continuation-in-Part application Ser. Nos. 574,662, 574,829, and 574,664, respectively, filed May 5, 1975, which are assigned to the same assignee as the present application, disclose new and improved elevator systems in which the strategy utilized by the supervisory control is suitable for a microprocessor, such as Intel's MCS-4 and MCS-8, Rockwell's PPS, Signetics's PIP, National's GPC/P and AMI's 7300. These applications will be hereinafter referred to as the earlier filed copending applications. The microprocessor offers an attractive cost package as well as flexibility due to the LSI circuitry and programmability. When the microprocessor offers programming flexibility at a modest cost, it imposes certain restrictions due to its relatively limited speed and memory capacity. The earlier filed copending applications set forth a universal operating strategy which accommodates all possible building configurations in which an elevator car may serve any combination of floors. The car controllers provide complete information to the system processor as to the building configuration which exists at any instant, and thus the supervisory control may be universally applied to any building without any significant modification.

The strategy operates within the limited operating speed of a microprocessor, because it does not decide when a hall call is registered which car should serve the call and then output the assignment of the call in a timely manner to a car. Rather, it periodically assigns the up and down service directions of the floors to the cars by dividing them among all in service elevator cars within the constrains of predetermined dynamic averages, which distributes the work load evenly among all of the elevator cars. Thus, the car assigned to a specific service direction from a floor will immediately see a hall call registered therefrom without any intercession required on the past of the supervisory control system.

Before each new assignment process, the supervisory system control clears all previously assigned landing service directions which do not have a registered hall call associated therewith. Assigned landing service directions which have a registered hall call associated therewith are not cleared and reassigned, as it could result in unnecessary movement of cars which start out to answer a hall call registered from an assigned landing service direction and suddenly no longer see the hall call when the assignment of the associated landing service direction is cleared and then reassigned, possibly to another elevator car.

SUMMARY OF THE INVENTION

Briefly, the present invention improves the universal operating strategy of the elevator system disclosed in the earlier filed copending applications. While the universal operating strategy of the earlier filed copending applications provides excellent elevator service, I have found that in certain circumstances it is possible for the answering of a hall call to be unduly delayed. The microprocessor is relatively slow, compared with the operating speed of a mini-computer, for example, and when used in the supervisory control of an elevator system, it may have a processing cycle as long a one or two seconds. The assignment of landing service directions to each elevator car starts at the advanced position of the elevator car and proceeds in its travel direction, defining an assignment loop which proceeds from the car, reversing as required at the terminals, and then proceeds back to the advanced car position. Thus, an elevator car may be assigned the service direction from a landing which corresponds to its advanced car position, the service direction from the next landing which conforms to the travel direction of the car, etc., skipping landing service directions already assigned until it reaches a limiting average. Depending upon the processing cycle time, the spacing between floors, and the speed of the elevator car, it is possible for the elevator car to move past the slowdown point of one or more floors it is assigned to before the next assignment is made. If the advanced position of an elevator car moves past the slowdown point for a floor it is asigned to and then a hall call is registered from this floor for the assigned service direction before the assignment is cleared and reassigned during the next running of the assignment program, the car will retain the assignment because assigned service directions which have a hall call associated therewith are not cleared and reassigned. Thus, a hall call of this category may wait until the elevator car makes almost a complete round trip before it will be answered.

The present invention minimizes the possibility for very long wait calls, and at the same time removes the critical dependence upon processing cycle time. Further, it accomplishes these results in a manner which requires very little additional instruction or code. This is important as memory capacity is limited in a microprocessor.

More specifically, the present invention modifies the manner in which assigned landing service directions are cleared prior to each new assignment of service directions. In addition to clearing the assignment of service directions which have no hall call associated therewith, assigned service directions which have a registered hall call are also cleared if they are behind the advanced position of the elevator car. A registered hall call is "behind" a car when the service direction of the hall call is the same as the travel direction of the car, but it is behind the advanced position of the car. For an up-traveling car, an up hall call would be behind the car if it is from a floor position one floor or more lower than the advanced car position. For a down traveling car, a down hall call would be behind the car if it is from a floor position one floor or more higher than the advanced car position. It is also possible for a registered hall call to be behind the call when the service direction of the hall call is not the same as the travel direction of the car, when the car is approaching a terminal during one assignment and is a the terminal before the next assignment is made and already has changed its travel direction.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIGS. 9A and 9B may be assembled to provide a sub-program which provides special floor functions, which function is shown in block form in FIG. 5;

FIGS. 10A and 10B may be assembled to provide a sub-program which provides the function of assigning scan slots, which function is shown in block form in FIG. 5.

DESCRIPTION OF PREFERRED EMBODIMENTS

Figure 1:
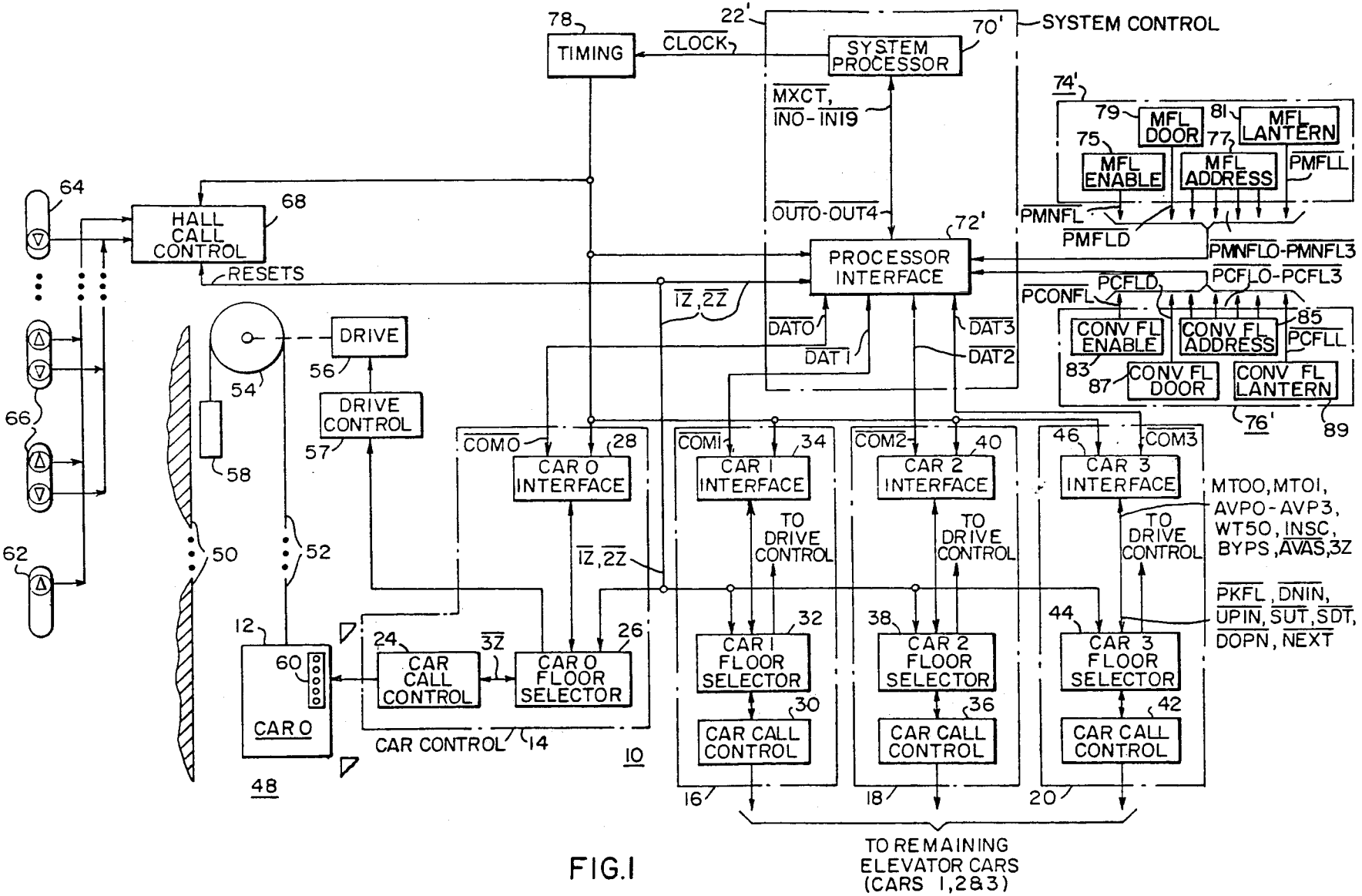
FIG. 1 is a partially schematic and partially block diagram of an elevator system, including supervisory system control which utilizes the teachings of the invention.

The present application relates to modifications and improvements to the elevator system disclosed in the hereinbefore mentioned earlier filed copending application 503,146; 503,201, and 503,212, which are hereby incorporated into the present application by reference. Only those portions of these copending applications which are necessary to understand and practice the present invention will be described in detail. Apparatus and steps of the earlier filed copending applications which are shown in the present application and are unchanged by the present application are identified with like reference numerals. Reference numerals in the present application which include a prime mark indicate the referenced apparatus or step of the earlier filed copending applications has been modified by the present application. New reference numerals are used to indicate apparatus and steps which are not shown in the copending applications.

Referring now to the drawings, and FIG. 1 in particular, there is shown an elevator system 10 which may utilize the teachings of the invention. Elevator system 10 includes a bank of elevator cars, with the controls 14, 16, 18 and 20 for four cars being illustrated for purposes of example. Only a single car 12 is illustrated, associated with car control 14, in order to simplify the drawing, since the remaining cars would be similar. Each car control includes a car call control function, a floor selector function, and an interface function for interfacing with supervisory system control 22'. The supervisory system control 22' controls the operating strategy of the elevator system as the elevator cars go about the business of answering hall calls.

More specifically, car control 14 includes car call control 24, a floor selector 26, and an interface circuit 28. Car control 16 includes car call control 30, a floor selector 32, and an interface circuit 34. Car control 18 includes car call control 36, a floor selector 38, and an interface circuit 40. Car control 20 includes car call control 42, a floor selector 44, and an interface circuit 46. Since each of the cars of the bank of cars and their controls are similar in construction and operation, only the controls for car 12 will be described in detail.

Car 12 is mounted in a hatchway 48 for movement relative to a building 50 having a plurality of floors or landings, with only a few landings being illustrated in order to simplify the drawing. The car 12 is supported by a rope 52 which is reeved over a traction sheave 54 mounted on the shaft of a suitable drive motor 56. Drive motor 56 is controlled by drive control 57. A counterweight 58 is connected to the other end of the rope 52.

Car calls, as registered by pushbutton array 60 mounted in the car 12, are recorded and serialized in the car call control 24, and the resulting serialized car call information is directed to the floor selector 26.

Halls calls, as registered by pushbuttons mounted in the halls, such as the up pushbutton 62 located at the bottom landing, the down pushbutton 64 located at the uppermost landing, and the up and down pushbuttons 66 located at the intermediate landings, are recorded and serialized in hall call control 68. The resulting serialized hall call information is directed to the floor selectors of all of the elevator cars, as well as to the supervisory system control 22.

The floor selector 26 keeps track of the car 12 and the calls for service for the car, and provides signals for the drive control 57. The floor selector 26 also provides signals for controlling such auxiliary devices as the door operator and hall lanterns, and it controls the resetting of the car call and hall call controls when a car or hall call has been serviced.

The present invention relates to new and improved group supervisory control for controlling a plurality of elevator cars as they go about the task of answering calls for elevator service, and any suitable floor selector may be used. For purposes of example, it will be assumed that the floor selector disclosed in U.S. Pat. No. 3,750,850, issued Aug. 7, 1973, will be used, which patent is asigned to the same assignee as the present application. This patent describes a floor selector for operating a single car, without regard to operation of the car in a bank of cars. U.S. Pat. No. 3,804,209, issued Apr. 16, 1974, discloses modifications to the floor selector of U.S. Pat. No. 3,750,850 to adapt it for control by a programmble system processor. In order to avoid duplication and limit the complexity of the present application, these patents, which are assigned to the same assignee as the present application, are hereby incorporated into this application by reference.

The supervisory system control 22' includes a processing function 70' and an interface function 72'. The processing function 70' receives car status signals from each of the car controllers, via the interface function 72', as well as the up and down halls calls, and provides assignment words for each car controller, which cause the elevator cars to serve the calls for elevator service according to a predetermined strategy. The car status signals provide information for the processing function 70' relative to what each car can do in the way of serving the various floors, and the processing function 70' makes assignments based on this car supplied information.

Special floor features, shown generally at 74' and 76', respectively, may be activated to provide special strategies relative to first and second selectable floors, respectively. The first special floor feature, which includes those features normally associated with the main or lobby floor of the building, are selected and enabled by apparatus shown in block form in FIG. 1. This apparatus may simply be in the form of electrical switches which provide a first predetermined voltage level when the switch is in one position, and a second predetermined voltage level when the switch is in another position, which voltages may be translated to logic one and logic zero levels, respectively, in the processor interface 72'.

The first special floor feature, shown generally at 74', includes an enable function 75, an address function 77, a door function 79, and a hall lantern function 81. When the associated switch of the enable function 75 provides a low signal $\overline{PMNEL}$, it activates the first special floor strategy of the system processor 70'. The opposite switch setting deactivtes the first special floor strategy. The address function 77 includes a plurality of switches, with the number of switches being sufficient to designate any floor of the building in binary. For a 16 floor building, four switches are sufficient, with the signals provided by the four switches designated $\overline{PMNFLO}$–$\overline{PMNFL3}$. Thus, when the enable function 75 is set to provide a true signal $\overline{PMNFL}$, the first special floor feature will be applied to the floor of the building designated by the binary address $\overline{PMNFLO}$–$\overline{PMNFL3}$. The door function 79 selects the position of the doors of the elevator car, or cars, parked at the selected floor by the first special floor strategy. A low signal $\overline{PMFLD}$ indicates the doors should be closed, while a high signal indicates the doors should be open. The hall lantern function 81 selects the service direction of a car parked at the special floor, and it also indicates which of the up or down hall lanterns should be energized when the door feature parks a car at the special floor with its doors open. A low signal $\overline{PMFLL}$ selects the down service direction and down hall lantern, while a high signal selects the up service direction and the up hall lantern.

In like manner, the second special floor feature, which for purposes of example includes those features normally associated with a convention floor, are selected by a plurality of switches shown generally at 76'. The second special floor feature incudes an enable function 83, an address function 85, a door function 87, and a hall lantern function 89. When the switch associated with the enable function is actuated to provide a true signal $\overline{PCONFL}$ which enables the feature, the strategy for the second special floor is applied to the floor associated with the address $\overline{PCFLO}$–$\overline{PCFL3}$ selected by the switches of the address function 85. The door function 87 selects the door position of a car parked at the special floor by the second special floor strategy, according to the logic level of a signal $\overline{PCFLD}$, and the hall lantern function 89, with a signal $\overline{PCFLL}$, determines the service direction of a car, and lights the associated hall lantern for cars which are parked at the second special floor with their doors open.

The supervisory system control 22' provides a timing signal $\overline{CLOCK}$ for synchronizing a system timing function 78. The system timing function 78 provides timing signals for controlling the flow of data between the various functions of the elevator system. The elevator system 10 is basically a serial, time multiplexed system, and precise timing must be generated in order to present data in the proper timed relationship. Each floor of the building to be serviced is assigned its own time or scan slot in each time cycle, and thus the number of time slots in a cycle is dictated by the number of floors in the associated building. Each floor has a different timing scan slot associated therewith, but it is not necessary that every scan slot be assigned to a floor level. Scan slots are generated in cycles of 16, 32, 64, or 128, so the specific cycle is selected such that there will be at least as many scan slots available as there are floor levels. For purposes of example, it will be assumed that there are 16 floors in the building described herein, so the cycle with 16 scan slots will be sufficient.

The 16 scan slot cycle is generated by a binary counter. For example, the binary address of scan slot 00 is 0000, and the binary address if scan slot 01 is 0001, etc.

In describing the elevator system 10 shown in FIG. 1 in more detail it will be helpful to set forth the various signals and their functions which will be hereinafter referred to, as well as as symbols used as program identifiers and program variables in the flow charts.

| SYMBOL | FUNCTION |
|---|---|
| $A_{CB}$ | Average number of calls in the building per in-service elevator car |
| $A_{CI}$ | Average number of calls in a set per in-service elevator car |
| $A_{SB}$ | Average number of scan slots in the building per in-service car |
| $A_{SI}$ | Average number of scan slots in a set per in-service car enabled to serve the set |
| AVAS | Car is available according to the floor selector |
| AVP0–AVP3 | Advanced car floor position in binary |
| BYPS | True when the car is bypassing hall calls |
| $\overline{CALL}$ | True when a car has car call or hall call in an assigned scan slot |
| $\overline{CLOCK}$ | Timing signal initiated by the system processor |
| CM-RAM 1 | Command control line from CPU to up to 4 RAMS |
| CM-RAM 2 | Command control line from CPU to up to 4 RAMS |
| CM-ROM | Command control line from CPU to up to 16 ROMS |
| $\overline{COM0}$–$\overline{COM3}$ | Serial control signals from system processor interface to 4 elevator cars |
| CONV | True when a car has a convention floor assignment |
| $\overline{DAT0}$–$\overline{DAT3}$ | Serial signal from 4 elevator cars to system processor interface |
| $\overline{DOPN}$ | Command from system processor to open car doors |
| D0–D3 | 4-bit data bus in system processor |
| $\overline{D89T}$ | True when motor generator set is shut down |
| FEN | Floor enable-true for floors car is enabled to see hall calls in at least one service direction |
| HRT | Half of a round trip |
| IDLE | True when car is in-service, not NEXT, and available according to floor selector |
| INSC | True when the car is in-service with the system processor |
| INSV | True when the car is in-service with the system processor and is not bypassing hall calls |
| $\overline{IN0}$–$\overline{IN19}$ | 20 inputs to the system processor |

-continued

| SYMBOL | FUNCTION |
|---|---|
| $\overline{MDCL}$ | A door signal which is true when the doors are closed |
| MT00 | Memory track signal which is true for floors for which car is enabled to see up hall calls |
| MT01 | Memory track signal which is true for floors car is enabled to see down hall calls |
| $\overline{MXCT}$ | Timing signal which is true during the last scan slot of the scan cycle |
| $N_{HCl}$ | Number of hall calls assigned to a car from a 1 car set |
| $N_{HCT}$ | Total number of hall calls assigned to car so far |
| $N_{CI}$ | Number of hall calls assigned to a car so far in the set being considered |
| $N_{CP}$ | A counter which is initialized to a count responsive to the position of the car |
| $N_{DIST}$ | Number of valid scan slots from the car so far in the assignment routine (used to determine when the half round trip limitation is met) |
| $\overline{NEXT}$ | Signal from system processor which is true when a car is designated as the next car to leave the main floor |
| $N_{POS}$ | The scan slot number which corresponds to the position of the car |
| $N_{RCC}$ | Number of registered hall calls assigned to a car in a set served by more than one car |
| $N_{SC}$ | Number of cars in-service in the bank |
| $N_{SCI}$ | Number of cars enabled to serve a set |
| $N_{SCF}$ | Number of cars enabled to serve the convention floor |
| $N_{SI}$ | Number of scan slots assigned to a car so far in the set being considered |
| $N_{SMF}$ | Number of cars which can serve the main floor |
| $N_{SS}$ | Total number of scan slots assigned to car so far |
| NXCV | Indicator for a car which when set indicates the car has a special floor assignment |
| $\overline{OUT0}$-$\overline{OUT4}$ | Serial signals from system processor to system processor interface |
| $\overline{PCFL0}$-$\overline{PCFL3}$ | The binary address of the second special floor |
| $\overline{PCFLD}$ | A signal which indicates the selected position of the doors of a car parked at the second special floor (0 = closed; 1 = open) |
| $\overline{PCFLL}$ | A signal which selects the hall lantern of a car parked at the second special floor with its doors open, and which sets the service direction of the car (0 = down; 1 = up) |
| $\overline{PCONFL}$ | A signal which is true when the second special floor feature is activated |
| $\overline{PKFL}$ | Parking signal from the system processor |
| $\overline{PMFLD}$ | A signal which indicates the selected position of the doors of a car parked at the first special floor (0 = closed; 1 = open) |
| $\overline{PMFLL}$ | signal which selects the hall lantern of a car parked at the first special floor with its doors open, and which sets the service direction of the car (0 = down; 1 = up) |
| $\overline{PMNFL}$ | A signal which is true when the first special floor feature is activated |
| $\overline{PMNFL0}$-$\overline{PMNFL3}$ | The binary address of the first special floor |
| $Q_{MNF}$ | Quota of cars to be maintained at the main floor |
| RAM | Random access memory |
| RES | Reset signal used to start up the supervisory system control |
| $\overline{ROM}$ | Read only memory |
| $\overline{SDT}$ | A command from the system processor to set the floor selector for down travel |
| $\overline{SUT}$ | A command from the system processor to set the floor selector for up travel |
| SYNC | Synchronizing signal generated by the system processor at the start of an instruction cycle |
| $\overline{UPIN}$ | The up call inhibit signal from the system processor |
| UPSCAN | Scanning direction for assigning scan slots to a car, 1 = up; 0 = down |
| WT50 | Indicates car load, 1 = greater than 50%, 0 = less than 50% |
| 1Z | Serial up hall calls |
| 2Z | Serial down hall calls |
| 3Z | Serial car calls |
| $\phi 1$ | Phase 1 of two non-overlapping clocks in the system processor |
| $\phi 2$ | Phase 2 of two non-overlapping clocks in the system processor |

Figure 2:
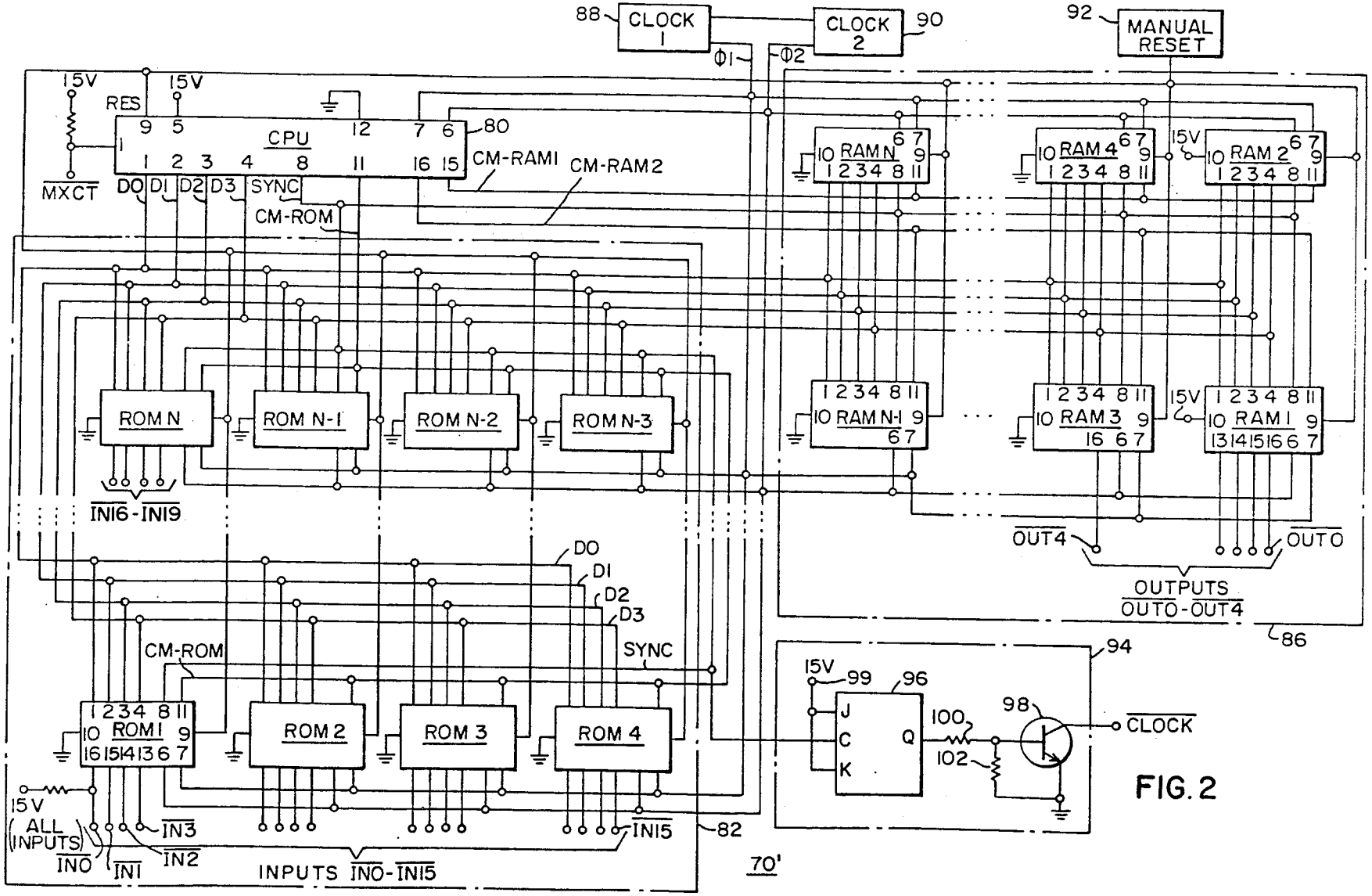
FIG. 2 is a schematic diagram of a system processor including a central processing unit (CPU) and companion ROMS and RAMS, which may be used for the system processor shown in block form in FIG. 1.

FIG. 2 is a schematic diagram of a system processor 70 which may be used for the processing function 70 of the supervisory system control 22 shown in block form in FIG. 1. Any suitable microprocessor may be used for the system processor 70, such as one of the hereinbefore mentioned microprocessors. For purposes of example, Intel Corporations' MCS-4 micro computer set will be described.

More specifically, the MCS-4 microprocessor includes a 4-bit parallel control and arithmetic unit 80 (Intel's 4004), hereinafter referred to as CPU 80, a control memory 82 which includes a plurality of programmable read only memories (ROMS) such as ROM 1 through ROM N (Intel's 4001), a data storage memory 86 which includes a plurality of random access memories (RAMS), such as RAM 1 through RAM N (Intel's 40002), clocks 88 and 90 which generate the basic system timing (750 KHZ) in the form of two non-overlapping clock phases 0.1 and 0.2, a manual reset 92, a clock 94 which provides timing signals $\overline{CLOCK}$ for external devices responsive to the timing produced by CPU 80.

CPU 80 communicates with the control memory 82 and the data storage memory 86 via a four line data bus DO, D1, D2 and D3, and with the peripheral portion of the elevator system through input and output ports in the control and data memories 82 and 86, respectively. CPU 80 includes a control line for each set of four RAMS, such as control lines CM-RAM 1 and CM-RAM 2, and a control line CM-ROM which is used to control a bank of up to 16 ROMS. CPU 80 is connected to clocks 88 and 90, and responsive thereto, ie., every 8 clock periods, issues a synchronizing signal SYNC. Signal SYNC is sent to the control and data memories 82 and 86, and to clock 94, to indicate the start of a 10.8 microsecond instruction cycle.

CPU 80 is connected to the manual reset 92, and it has a test pin connected to receive signal $\overline{MXCT}$. Signal $\overline{MXCT}$ is true during the last scan slot of each scan cycle.

Each of the ROMS are connected to the data bus DO, D1, D2 and D3, to the clock phases 0.1 and 0.25 to ROM control line CM-ROM, to the synchronizing line SYNC, and to the reset 92. ROMS 1, 2, 3, 4 and N each have 4 inputs for receiving input information from the elevator system, with these 20 inputs being referenced $\overline{IN0}$ through $\overline{IN19}$.

Each of the RAMS are connected to the data bus DO, D1, D2 and D3, to the clock phases 0.1 and 0.2, to one of the RAM control lines CM-RAM 1 or CM-RAM2, to the synchronizing line SYNC, and to the reset 92. RAMS 1 and 3 each have outputs for sending information to the elevator system, with these outputs being referenced $\overline{OUT0}$ through $\overline{OUT4}$.

Reset 92 is manually actuated during startup of the elevator system. A low reset signal clears the memories and registers in CPU 80, it sets the data bus to zero, it clears static flip-flops in the control memory 82 as well as inhibiting data out, and it clears the data memory 86.

Clock 94 may include a JK flip-flop 96 and an NPN transistor 98. The J and K inputs of flip-flop 96 are connected to a unidirectional supply voltage, at terminal 99, and its clock input C is connected to the synchronizing line SYNC. ITS Q output is connected to the base of transistor 98 via resistor 100. The base of transistor 98 is also connected to ground via resistor 102, its emitter is connected to ground, and its collector is connected to output terminal $\overline{\text{CLOCK}}$. Signal $\overline{\text{SYNC}}$ is low during the last subcycle (1.35 microsecond) of the 10.8 microsecond instruction cycle and the flip-flop 96 changes its output state on the positive going transition of SYNC. Thus, the signal $\overline{\text{CLOCK}}$ is a square wave, with each half cycle being one complete instruction cycle (10.8 microseconds).

CPU 80 includes an address register, an index register, a 4-bit adder, and an instruction register. The index register is a random access memory of 16 × 4 bits. The 16 4-bit locations, referenced RO-R15, may be directly addressed for computation and control, and they may also be addressed as 8 pairsof storage locations, referenced PO-P7 for addressing RAMS or ROMS, or storing data from the ROMS.

Each of the ROMS of the control memory 82 stores 256 × 8 words of program or data tables, and is provided with 4 I/O pins and control for performing input and output operations. CPU 80 sends an address to the control memory, along with a ROM number, during the first three instruction subcycles, and the selected ROM sends an instruction to CPU 80 during the net two instruction sybcycles. The instruction is executed, ie., data is operated on in CPU 80, or data or address is sent to or from CPU 80, during the last three subcycles of the instruction cycle. When an I/O instruction is received from the control memory 82, data is transferred to or from the accumulator of CPU 80 on the 4 data lines connected to the control memory 82.

Each of the RAMS of the data memory 86 stores 320 bits arranged in 4 registers of 20 4-bit characters each, 16 of which are addressable by one instruction, and 4 of which are addressable by another instruction. The 16 bits of each register form a main memory, while the 4 bits form a status character memory. The address of one of the RAMS, register and character is stored in two index regiters in CPU 80 and is transferred to the selectrd RAM during two subcycles of the instruction cycle when a RAM instruction is executed. When the RAM output instruction is received by CPU 80, the content of the accumulator of CPU 80 is transferred to the four RAM outpt lines.

Figure 3:
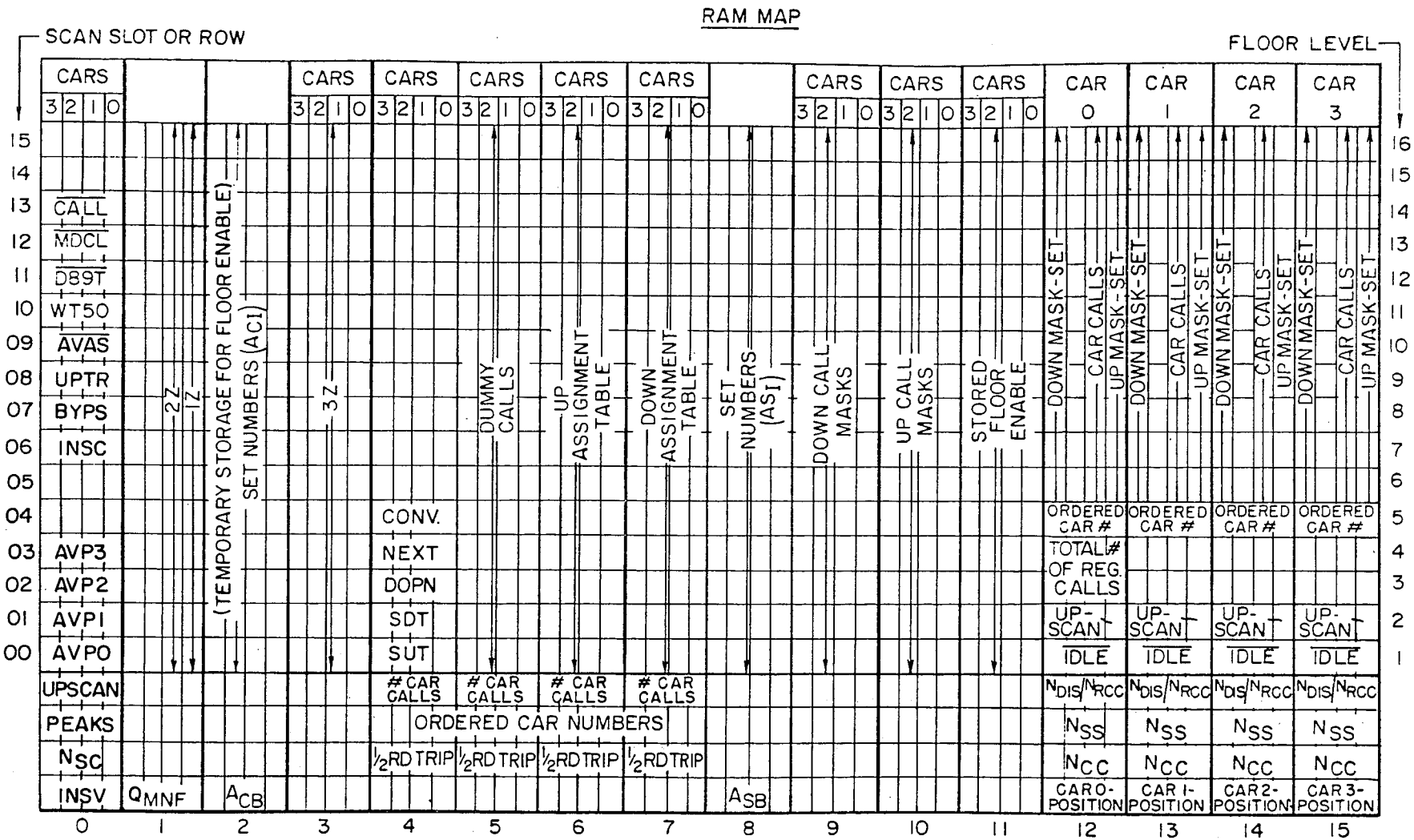
FIG. 3 is a RAM map illustrating the format of 16 20-bit registers provided by the RAMS shown in FIG. 2.

FIG. 3 is a RAM map, which diagrammatically illustrates 16 of the registers, 0–15 in the data memory 86. The lower four rows, form the status character memories of the register, while the upper 16 rows, labeled 00–15, form the main memory of the registers. The specific functions of the registers will be hereinafter described as the signals and data stored therein are referred to.

As shown in FIG. 1, each of the four elevator cars sends its status signals to the system processor 70' of the supervisory system control 22', via the interface 742'. The status signals from each car are seralized by multiplexers, with these serial signals from elevator cars 0, 1, 2 and 3 being indicated by symbols $\overline{\text{DAT0}}$, $\overline{\text{DAT1}}$, $\overline{\text{DAT2}}$, and $\overline{\text{DAT3}}$ respectively.

The up and down hall calls are each seralized in the hall call control 68 shown in FIG. 1, with the serial up and down hall calls being referred to as $\overline{\text{1Z}}$ and $\overline{\text{2Z}}$, respectively. The serial signals $\overline{\text{DAT0}}$, $\overline{\text{DAT1}}$, $\overline{\text{DAT2}}$, $\overline{\text{DAT3}}$, $\overline{\text{1Z}}$ and $\overline{\text{2Z}}$ are all applied to interface 72'. The up hall calls 1Z and the down hall calls $\overline{\text{2Z}}$ are combined with the status signals $\overline{\text{DAT0}}$ and $\overline{\text{DAT1}}$, respectively, in interface 72', to provide output signals $\overline{\text{IN0}}$ and $\overline{\text{IN1}}$, respectively. The serial signals $\overline{\text{DAT2}}$ and $\overline{\text{DAT3}}$ from cars 2 and 3, respectively, are connected to output terminals $\overline{\text{IN2}}$ and $\overline{\text{IN3}}$ via buffers in interface 72'.

The elevator system 10 may be operated with or without a floor designated as the first special floor, such as a floor for which main floor features are desired. Further, when it is operated with a main floor, any floor of the building may be selected as the main floor. If the first special floor feature is enabled, a predetermined quota is selected which indicates the desired number of cars to be maintained at the first special or main floor, and this quota may be modified automatically by existing traffic conditions. For example, in a 4 car system the quota may be selected to be one, which is modified to two during an up peak condition, and to zero during a down peak condition.

An up peak condition may be detected by a car leaving the main floor in the up direction with a predetermined load, and if the system is not on down peak, this occurrence starts a timer to place the system on up peak for a predetermined period of time. Each subsequent car leaving the main floor set for up travel, set to bypass hall calls, resets the timer to its maximum count, to extend the time the system is on up peak.

A down peak condition may be detected by a car above the main floor generating a bypass signal in the down direction. This occurrence also starts the peak timer, placing the system on down peak for a predetermined time period, overriding up peak if the system should happen to also be in an up peak condition. Each subsequent car which bypasses hall calls in the down direction resets the timer to its maximum count.

Figure 4:
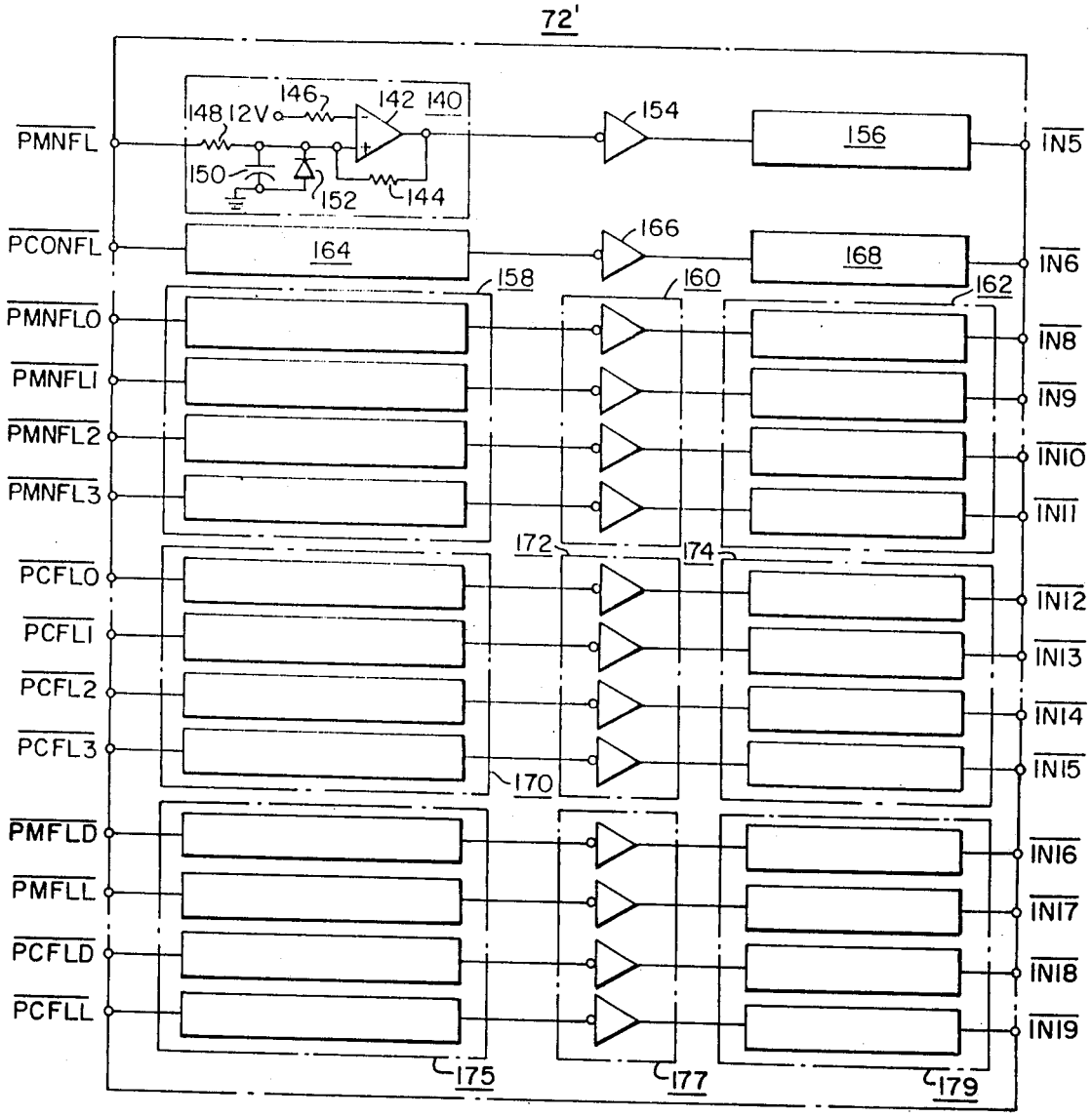
FIG. 4 is a schematic diagram of an interface circuit which may be used for the processor interface shown in FIG. 1.

FIG. 4 is a schematic diagram of that portion of processor interface 72' which relates to the special floor features.

The first special floor feature is selected by a switch shown generally at 75 in FIG. 1, with the output signal $\overline{\text{PMNFL}}$ of the enable function 75 being connected to an input terminal of interface 72' which has the same reference letters. The switch applies a relatively high voltage to input terminal $\overline{\text{PMNFL}}$ when the main floor feature is not desired, and a low voltage or ground level signal when the feature is desired. Input terminal $\overline{\text{PMNFL}}$ is connected to a high level input interface 140. Interface 140 may include operational amplifier 142, resistors 144, 146 and 148, a capacitor 150, and a diode 152. Resistor 144 is connected from the output of amplifier 142 to its non-inverting input. Its inverting input is connected to a positive unidirectional voltage supply, such as 12 volts, via resistor 146. Its non-inverting input is connected to input terminal $\overline{\text{PMNFL}}$ via resistor 148, to ground via capacitor 150, and to ground via diode 152. Diode 152 is poled to conduct current from ground into the non-inverting terminal. When terminal $\overline{\text{PMNFL}}$ is high, indicating the main floor feature is not desired, the voltage at input terminal $\overline{\text{PMNFL}}$ exceeds the voltage applied to the inverting input and the output of the operational amplifier 142 will be positive, ie., at the logic one level, which is inverted by an inverter 154 to the logic zero level and applied to an output buffer 156. Buffer 156 inverts the logic 0 to a logic 1, and applies the logic one to output terminal $\overline{IN5}$. When signal $\overline{PMNFL}$ is true (low) the voltage applied to the inverting input exceeds that applied to the non-inverting input and the output of operational amplifier 142 goes to a logic zero level. Inverter 154 inverts this signal to a logic one, and buffer 156 inverts this to a logic 0, which is the true level for output terminal $\overline{IN5}$.

The binary address of the floor selected as the first special or main floor is applied to input terminals $\overline{PMNFLO}$, $\overline{PMNFL1}$, $\overline{PMNFL2}$ and $\overline{PMNFL3}$. The signals applied to these input terminals are applied to output terminals $\overline{IN8}$, $\overline{IN9}$, $\overline{IN10}$ and $\overline{IN11}$, respectively, each via a high level interface, an inverter, and an output buffer, shown generally at 158, 160 and 162, respectively. The high level input interfaces shown generally at 158, as well as the remaining high level input interfaces shown in FIG. 4 are all similar to interface 140.

The elevator system 10 may be operated with or without a floor designated as a second special or convention floor, as desired, with the convention floor feature being indicated at 76' in FIG. 1. While the second special floor will be referred to as a convention floor, it may be used for any other function, such as operating with the first special floor to provide a dual lobby. It may also be set to the same floor number selected by the first special floor feature to provide dispatching in both the up and down directions for a selected special floor. It also allows cars to be parked at a single selected floor, some with open doors and some with closed doors, set for the same, or opposite, travel directions. The convention floor may be defined as any floor at any time by a binary number.

The second special floor feature is selected by a switch shown generally at 83 in FIG. 1, with the output signal $\overline{PCONFL}$ being connected to an input terminal of interface 72' which has the same reference letters. Similar to the signal selecting the main floor feature, signal $\overline{PCONFL}$ is applied to a high level input interface 164, the output of which is inverted by inverter 166, and applied to output buffer 168. The output of buffer 168 is connected to output terminal $\overline{IN6}$.

The binary address of the floor selected as the second special or convention floor is connected to input terminals $\overline{PCFL0}$, $\overline{PCFL1}$, $\overline{PCFL2}$ and $\overline{PCFL3}$. The signals applied to these input terminals are applied to output terminals $\overline{IN12}$, $\overline{IN13}$, $\overline{IN14}$ and $\overline{IN15}$, respectively, each via a high level input interface, an inverter, and an output buffer, shown generally at 170, 172 and 174, respectively.

Signals $\overline{PMFLD}$ and $\overline{PMFLL}$, which select the door and service direction functions of the first special floor, respectively, and signal $\overline{PCFLD}$ and $\overline{PCFLL}$, which select the door and service direction functions of the second special floor, respectively, are connected to like referenced input terminals of interface 72'. After these signals are processed by the high level interface, inverter and buffer functions, shown generally at 175, 177 and 179, respectively, they are connected to output terminals $\overline{IN16}$, $\overline{IN17}$, $\overline{IN18}$ and $\overline{IN19}$, respectively.

Output terminals OUT0, OUT1, OUT2 and OUT3 from the data memory 86 shown in FIG. 2 intermittently provide serial data words for the elevator cars 0, 1, 2 and 3, respectively. These data words contain the inhibits and commands which cause the elevator cars to answer calls for elevator service according to the operating strategy of the system processor 70'. These output terminals, along with output terminal $\overline{OUT4}$, are connected to the processor interface 72'. Additional output terminals from the data memory 86 would be provided for elevator systems having more than 4 cars. Terminals $\overline{OUT0}$, $\overline{OUT1}$, $\overline{OUT2}$ and $\overline{OUT3}$ are connected to output terminals $\overline{COM0}$, $\overline{COM1}$, $\overline{COM2}$ and $\overline{COM3}$, respectively, each through an inverter and an inverting output buffer.

Figure 5:
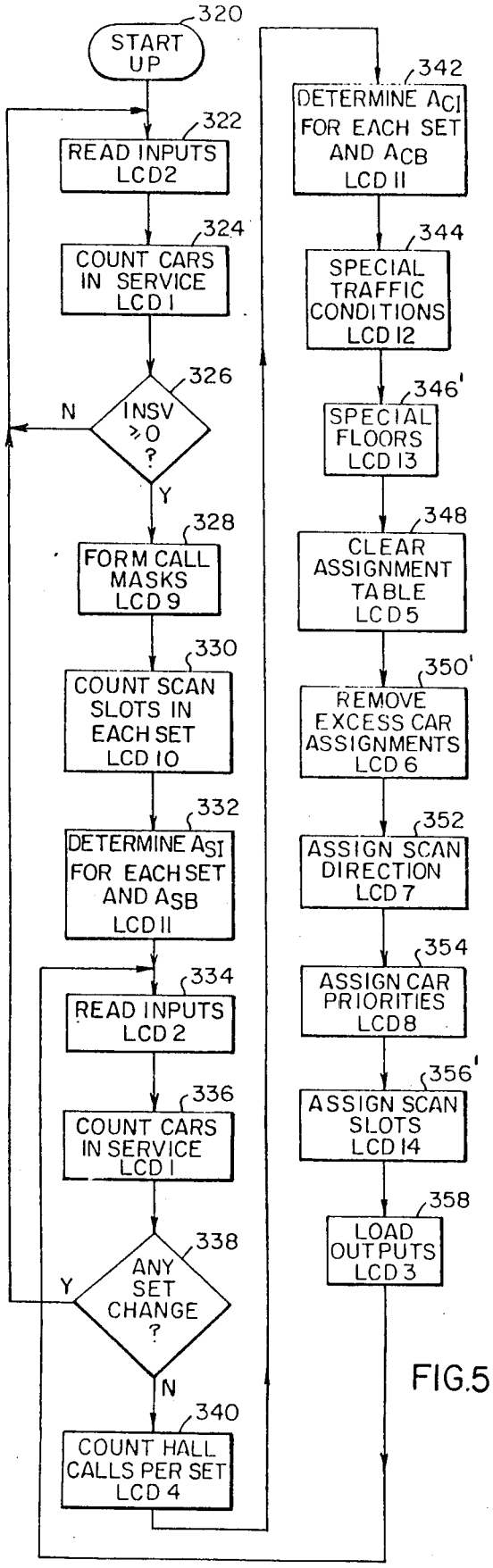
FIG. 5 is a flow chart which illustrates group supervisory strategy for controlling a plurality of elevator cars which may utilize the teachings of the invention.

FIG. 5 is a block diagram which broadly sets forth new and improved group supervisory strategy for controlling a bank of elevator cars to answer calls for elevator service according to the teachings of the invention. The system shown in FIG. 5 outlines a program for implementing the strategy of the invention, with each of the blocks shown in FIG. 5 being fully developed in flow charts included in the hereinbefore mentioned copending applications. The present application includes detailed flow charts for those portions of the program to which the invention is directed. The flow charts which are included in the present application are programmers flow charts, which, when taken with the remaining figures, the specification, the hereinbefore mentioned copending applications, and a users manual for a microprocessor, provide sufficient detail for a programmer of ordinary skill to write the necessary instructions to program the microprocessor. However, a program listing illustrative of a specific embodiment of the invention is included in the concurrently filed application Ser. No. 574,828, filed May 5, 1975, which is a continuation-in-part of the hereinbefore mentioned application Ser. No. 503,201, filed Sept. 4, 1974. The program listing in this application is hereby incorporated by reference. The blocks of FIG. 5 also include an LCD identification number which refers to subprograms shown in the flow charts.

In general the new and improved group supervisory strategy is universal in character, enabling it to be applied without significant modification to any building. The system processor is completely dependent upon information from the various car controllers as to what each car is capable of doing. The system processor uses this information to set up the specific building configuration which presently exists, ie., which cars are in service and which floors and service directions therefrom these in-service cars are enabled to serve. The system processor then applies its universal strategy to this configuration.

The universal strategy attempts to evenly distribute, among all in-service cars, the actual work load, as well as the work load which may arise between assignments. The distribution of this actual and possible work load is based upon certain dynamic averages calculated just prior to the making of assignments.

The assignments are primarily "hall button" oriented, rather than "hall call" oriented, at least until the hall calls "assigned" to a car because of the assignment of hall buttons meets one of the applicable dynamic averages. Each hall call button is effectively assigned a scan slot, and these scan slots are assigned to the cars according to the universal strategy. The elevator system is a serial, time multiplexed arrangement in which the scan slots for the floors are taken in turn.

The assignment of scan slots to the various cars is not made on the basis of an inflexible block of adjacent floors, normally associated with the zone concept, it is not made on the basis of a flexible block of adjacent floors normally associated with the floating zone concept between adjacent cars, and it is not a random operation. The assignment of scan slots is built into a predetermined priority structure which includes:

1. the clearing of certain scan slot assignments before each assignment process;

2. the assignment of scan slots in a general order based upon the floors served by the same combination of cars, with each such group being called a "set;"

3. the assignment of the scan slots of the sets in a plurality of assignment passes, changing the limitations applied and controlling dynamic averages on each pass, with the limitations and dynamic averages including those which are set oriented, as well as building oriented;

4. the assignment of scan slots to the cars enabled for each set according to a dynamic car priority order, calculated prior to each assignment process on the basis of actual work load, as well as considering such factors as whether or not the car has the NEXT assignment, and if the motor-generator set associated with a car is shut down due to a predetermined period of inactivity;

5. the assignment of scan slots to the cars, starting from the cars in a predetermined direction, with the predetermined direction for a busy car being its travel direction and with a predetermined direction for an idle car being based upon the currently existing traffic conditions and the assignment directions for the busy cars;

6. the assignment of scan slots to busy cars with the limitation that the associated floors are within a predetermined travel distance from the car, as opposed to physical separation; and 7. assigning scan slots to in-service idle cars without the travel distance limitation of (6).

The description of the assignment process refers to the assignment of scan slots to the cars. The scan slots are each associated with a different hall call pushbutton, and the hall call pushbuttons are related to directions from the floors that traffic located at the floors desires to travel. Thus, the assignment of scan slots to the cars may be considered to be the assignment of landings, and service directions therefrom, to the cars, or briefly, the assignment of service directions from landings to the cars. It should be noted that the term "service direction,"when applied to landings in the assignment process, refers to the direction from the floor that traffic at the floor desires to travel, and is not related to the setting of the service directions for the various elevator cars.

More specifically, startup of the elevator system 10 shown in FIG. 1 is indicated at terminal 320. Step 322 reads the input signals $\overline{IN0}$ through $\overline{IN3}$ applied to the input port of the control memory 82 (FIG. 2) from the various cars, and stores the signals in the data storage memory 86. Step 324 counts the number of elevator cars which are in-service with the system control 22 ($N_{SC}$), and step 326 determines if there are at least two cars under the control of the system control 22. If not, there is no need for group supervisory control and the program loops back to step 322. THe program remains in this loop until at least two cars are in-service with the system control 22. Without group supervisory control, the cars are enabled to see all hall calls and they will answer calls for elevator service according to the strategy built into their individual car controllers, as hereinbefore described.

If step 326 finds there are at least two or more cars in-service with the system control 22, the program advances to step 328 which forms down and up call masks. The down and up call masks are stored in the main memory of RAMS 9 and 10, respectively, of the data storage memory 86. When RAMS 0–15 are referred to, it will be helpful to check the RAM number in the RAM map of FIG. 3. RAMS 9 and 10 essentially display the down and up floor enable signals MT01 and MT00, respectively, indicating, for each car, the floors and directions therefrom which may be served by the car. Thus, if the binary word of RAM 10, which corresponds to floor level 15 is 0111, for example, it would indicate that only cars 0, 1 and 2 are able to serve an up hall call from floor level 15. It will be noted that this arrangement preserves the universality of the program, making is applicable to any building configuration, as the program obtains the information as to the building configuration from the cars, and then stores the building configuration for reference until a change occurs.

Step 330 counts the scan slots in each set as well as the total number of scan slots in the building and stores these sums for future reference. Each hall call pushbutton is assigned a scan slot. Thus, in a building with 16 levels, the first and sixteenth levels would have 1 scan slot, and the intervening 14 floors or levels would each have 2 scan slots, making a total of 30 scan slots. A set refers to a group of floors served by the same combination of cars. With four cars, for example, there may be as many as 16 different sets, with the set 0000 being an invalid set. If all cars serve all floors, there would only be 1 valid set. In the average building configuration, there would usually only be a few sets, but the program will handle the maximum number of sets possible.

Step 332 determines the average number of scan slots per set, $A_{SI}$, by dividing the scan slots in each set, determined in step 330, by the number of in-service cars capable of serving the set ($N_{SCI}$). Step 332 also determines $A_{SB}$, the average number of scan slots in the building per in-service elevator car, by dividing the total number of scan slots in the building by $N_{SC}$, the number of cars in-service.

Steps 334 and 336 then repeat steps 332 and 336, respectively, reading the input port of ROM 1 of control memory 82, and counting the cars in-service. Step 338 determines if there has been a change in the building configuration since the last reading of the input port. For example, step 338 determines if the number of in-service cars has changed. If there has been a change, the program returns to step 322, as the floor enable masks and scan slot averages previously formulated may no longer be valid, and thus should be updated using the latest building configuration.

If step 338 finds that there has been no change which invalidates $N_{SC}$, $A_{SB}$, or $A_{SI}$ for any set, the program advances to step 340. Step 340 counts the number of hall calls per set, as well as the total number of hall calls in the building, and stores these sums for future reference.

Step 342 deermines the average number of registered hall calls per set, $A_{CI}$, by dividing the number of hall calls in each set by the number of in-service cars serving the set. The average number of registered hall calls per car in the building, $A_{CB}$, is determined by dividing the total number of hall calls in the building by $N_{SC}$, the number of in-service elevator cars.

Figure 11:
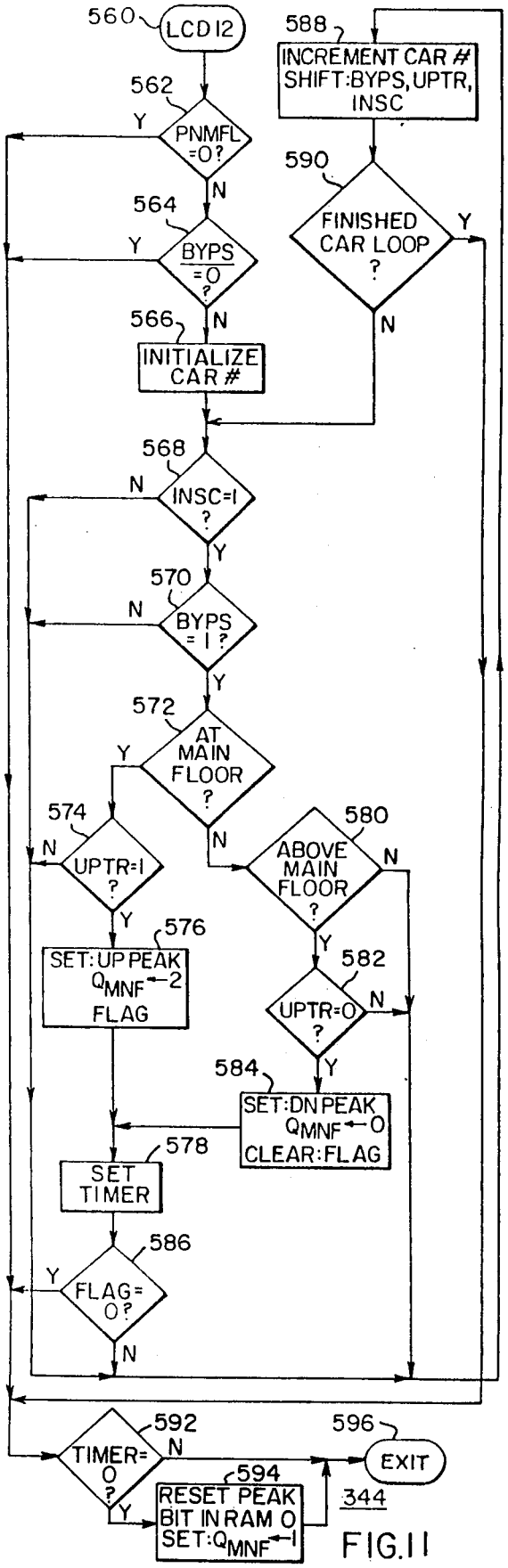
FIG. 11 is a sub-program which illustrates the function of detecting special traffic conditions, and setting appropriate indicators, which function is illustrated in block form in FIG. 5.

Step 344 checks for special traffic conditions, such as those which initiate up peak and down peak features. If a condition is detected which initiates a peak traffic condition, step 344 implements the strategy associated with the specific peak detected. A detailed flow chart for step 344 is shown in FIG. 11.

Figure 9A:
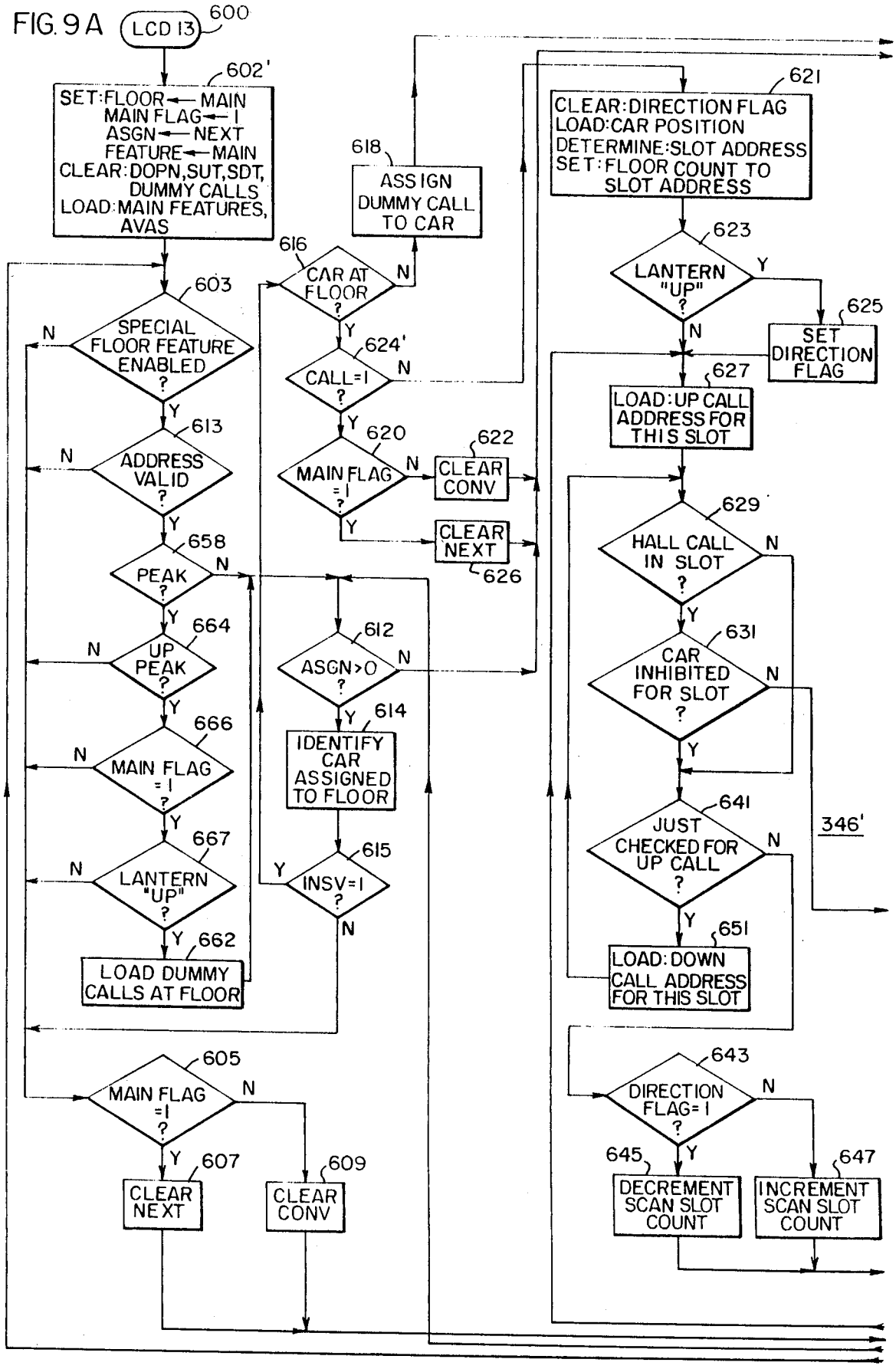

Step 346′ checks for special floor features, such as main and convention floor features. If a request for one or more special floor features is present, step 346′ implements the strategy associated with the special floor features selected. A detailed flow chart for step 346+ is shown in FIGS. 9A and 9B.

Step 348 clears the up and down assignment tables, stored in RAMS 6 and 7, respectively, of all scan slot assignments except those previously assigned scan slots which have a registered hall call associated therewith, and those scan slots from a one car set.

Figure 6:
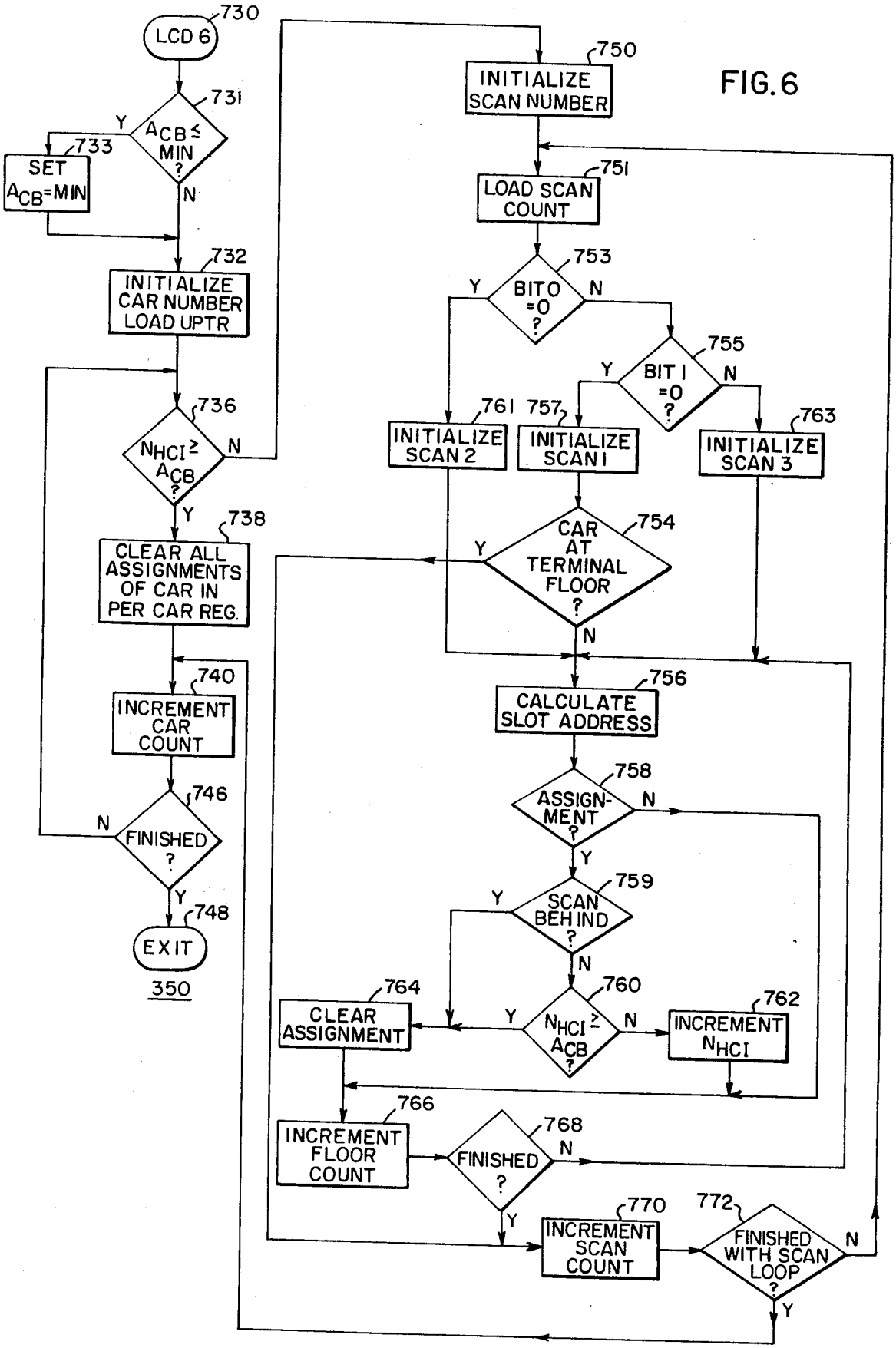
FIG. 6 is a sub-program which illustrates the function of removing excess scan slot assignments according to the teachings of the invention, which function is shown in block form in FIG. 5.

Step 350′ removes any excess scan slot assignments, For example, if the number of calls from a one car set assigned to the car equals or exceeds the hall call per car building average $A_{CB}$, all other assignments to this car are cleared. If the calls assigned to a car from a one car set do not exceed $A_{CB}$, but all calls assigned to the car equals are exceeds $A_{CB}$, step 350′ counts the scan slots assigned to the car which have a registered hall call, starting at the scan slot associated with the position of the car and proceeding in the travel direction of the car, and once the building call average per car $A_{CB}$ is met, all further scan slots assigned to this car are cleared. Step 350′ also removes scan slots having a hall call associated therewith, which are behind the advanced position of the car they are assigned to. A detailed flow chart for step 350′ is shown in FIG. 6.

Step 352 assigns the direction from an in-service idle car in which the assignment of scan slots are to be made to the car. If a car is busy, the scan direction for assigning scan slots to the car is the car's travel direction. The assigned scan directions of the busy cars are considered, along with the present traffic conditions, in deciding the scan direction to be assigned to an in-service idle car. In certain instances it is also suitable to use the last travel direction of an in-service idle car.

Step 354 assigns the order in which the cars are to be considered when assigning scan slots to them, with the car having the fewest combined car and hall calls being considered first, etc.

Step 356′ assigns the scan slots of each set to the cars, in the car order determined by step 354. The sets are considered in the order of increasing number of cars per set. The assignment of the scan slots to the cars associated with each set are made in a plurality of passes, such as three. The first assignment pass is a specific assignment pass which takes care of preidentified situations and priorities. For example, scan slots associated with floors for which the cars have a car call are assigned to the appropriate cars; the up and down scan slots associated with a floor at which an in-service idle car is standing, are assigned to that car; if there is a car with a NEXT assignment, this car is assigned the scan slot associated with the main floor and selected service direction; and, if there is a car with a convention floor assignment CONV, this car is assigned the scan slot associated with the convention floor and selected service direction. The second pass is a general assignment which assigns scan slots to the cars of the sets subject to predetermined dynamic limiting averages and a distance limitation. A predetermined peak traffic condition modifies the affect of certain of the limiting averages and the distance limitation. A third pass may be used to try to assign any unassigned scan slots which may remain after the first two passes. The third pass removes certain limitations used during the second pass. A detailed flow chart for step 356′ is shown in FIGS. 10A and 10B.

Step 358 reads RAMS 4, 5, 6 and 7 to the output port of the data storage memory 86, where the information from these RAMS appear as serial output signals $\overline{OUT0}$, $\overline{OUT1}$, $\overline{OUT2}$ and $\overline{OUT3}$ for cars 0, 1, 2 and 3, respectively.

After outputting the assignments to the cars, the program returns to step 334, hereinbefore described.

FIG. 6 is a flow chart of a sub-program LCD6 which may be used to perform the block function 350′ in FIG. 5, which function removes excess scan slot assignments from the cars, if any, using the average number of calls per car in the building, $A_{CB}$, as the guide. Function 350′ also removes scan slots having a hall call associated therewith, which are behind the advanced position of the car to which they are assigned LCD5 (step 348 of FIG. 5) only places assignments in the per car registers (RAMS 12, 13, 14 and 15 of FIG. 3) for sets served by more than one car. Thus, the floors assigned in the per car register are served by other cars and will be reassigned in LCD14 (steps 356′ of FIG. 5) if the assignment is removed in LCD6. The assignments for the one car sets were placed directly in RAMS 6 and 7 of FIG. 3 by LCD5.

Sub-program LCD6 is entered at terminal 730. Step 731 checks to set if $A_{CB}$ is less than a predetermined minimum value, such as 2, and if it is, step 733 sets $A_{CB}$ to this minimum. Steps 731 and 733 proceed to step 732 which initializes the car count and loads the word UPTR from RAMO to a temporary storage location.

Step 736 determines if the hall calls assigned to this car from one car sets, totaled in $N_{HCl}$ for the car in LCD5, is equal to, or greater than $A_{CB}$. If so, this car has all it can handle from floors only served by this car, and step 738 removes any scan slot assignments to this car which are in the per car registers. Step 740 increments the car count and step 746 checks to see if all cars have been considered. If they have, the program exits at terminal 748. If all cars have not been considered, the program returns to step 736.

In the hereinbefore mentioned copending applications sub-program LCD6 at this point totaled the hall calls assigned to the car being considered by adding $N_{HCl}$, the hall calls assigned to the car from one car sets and $N_{RCC}$, the hall calls assigned to the car from sets served by more than one car. If the total did not equal or exceed $A_{CB}$ the variable $N_{HCT}$ was set equal to this total and the program proceeded to the next car. These steps are eliminated in the new LCD6 sub-program shown in FIG. 6, and all scan slot assignments to a car which have a hall call associated therewith, from a set served by more than one car, will be examined. This change allows the position of a hall call relative to the advanced position of the car it is assigned to, to be checked, and the assignment of the scan slot can be cleared if it is behind the car. The advanced position of the elevator car is always available in RAM O shown in FIG. 3, as binary signals AVPO–AVP3. The scan slot, if cleared, will be reassigned in LCD14 to a more suitable car. The removal of this scan slot and associated call, in addition to providing better service to this call, also allows this elevator car to be assigned another scan slot havng a registered hall call in LCD14, which it would otherwise not be entitled to receive. This checking of all scan slots havin a hall call associated therewith from sets served by more than one car also removes the criticality of the cycle processing time in assuring prompt elevator service to all hall calls, and with this modification the universal strategy of the copending applications is even more suitable for a low cost microprocessor.

More specifically, according to the new and improved sub-program LCD6, if step 736 finds that the number of scan slots having hall calls associated therewith assigned to the car from a one car set is not greater than or equal to $A_{CB}$, the building hall call per car average, the program advances to set 750. In the portion of the program which starts with step 750, the program starts at the scan slot of the advanced floor position of the car and, proceeding from the car in the selected scan direction, as checked by a bit in the word UPSCAN (RAM O of FIG. 3), it counts the scan slots assigned to the car. All scan slots assigned to the cars in the per car registers have a hall call associated therewith. Thus, once a count equal to $A_{CB}$ is reached, any further scan slots which are encountered assigned to this car are removed from the per car registers.

The different portions of the scan cycle which examine the scan slots, starting at the car, are given scan numbers according to the following code:

Scan 1:The scan which starts at the location of the car and proceeds to one end of the scan cycle. This scan is given the binary count 01.

Scan 2: The scan which reverses direction at the end of scan 1 and proceeds to the other end of the scan cycle.

Scan 3: The scan which reverse direction at the end of Scan 2 and proceeds back to the scan slot of the car.

Returning now to FIG. 6, step 750 initializes the scan number to scan 1, using the binary number 01, and step 751 loads this number to a temporary location. Step 753 checks the least significant bit of the scan count by asking if bit location 0 is equal to 0. Since it was just set to 01, the answer is no, and step 755 then checks the next bit position by asking if bit location 1 is equal to 0. If the answer is yes, then this is scan 1 and step 757 initializes scan 1 and proceeds to step 754. Step 754 checks to see if the car is at a terminal floor. If so, there will only be 2 scans, instead of 3, and the program advances to step 770 to increment the binary scan count number from 01 to 10. If the car is not at a terminal floor, step 756 determines the scan slot address (floor level of the car minus one) of the first scan slot to be considered and step 758 determines if it is assigned to the car being considered. If it is not, step 766 increments the floor count.

If the scan slot is assigned to this car, step 759, which is a step added in this new and improved LCD6, checks to see if the scan slot is behind the advanced floor position of the elevator car. If the scan slot is behind the advanced position of the elevator car, step 764 clears the assignment and step 766 increments the floor count. The rationale behind this new step, and the meaning of the word behind will now be explained.

Figures 7, 8:
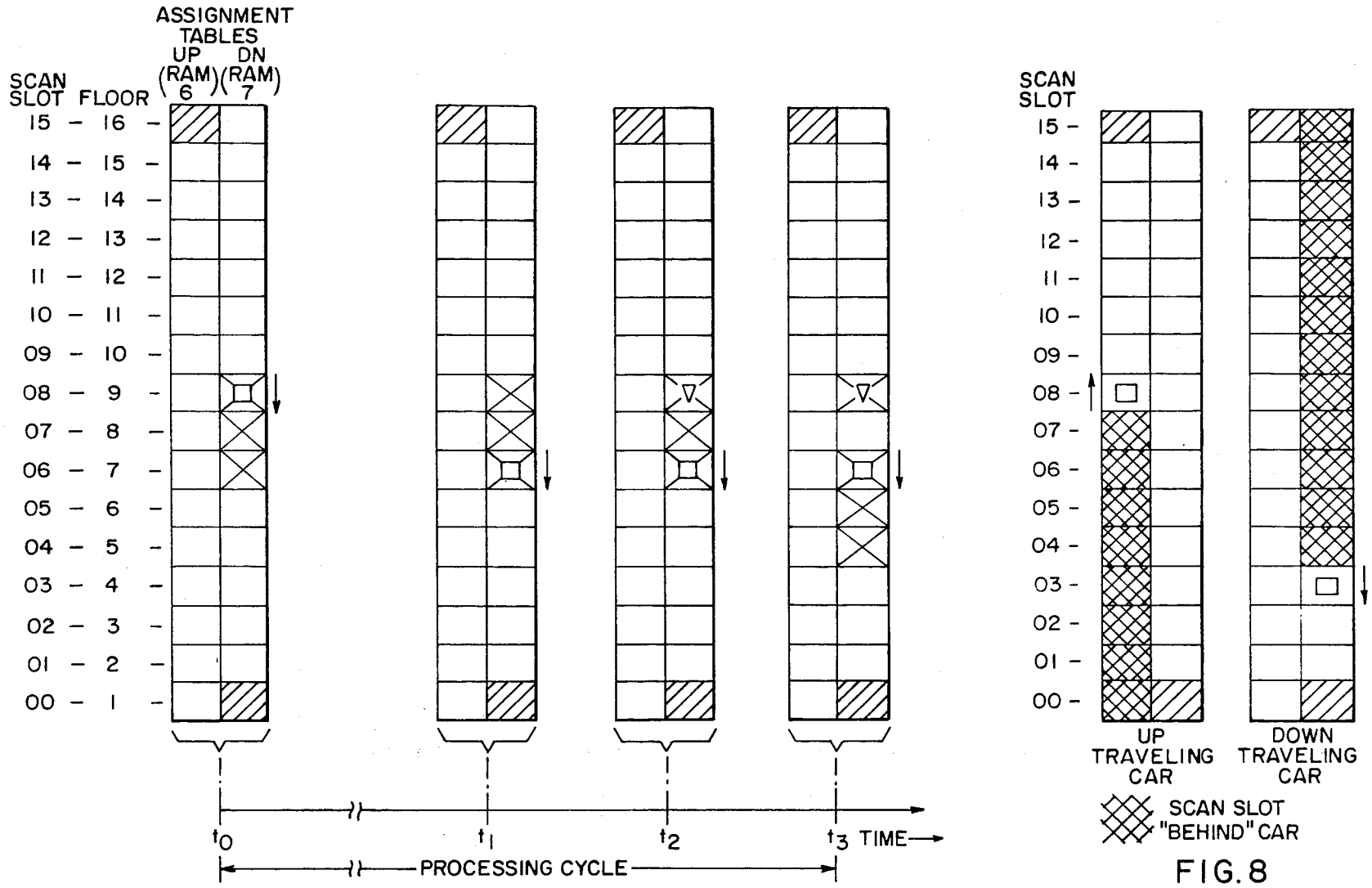
FIGS. 7 and 8 are diagrams which are useful in understanding the sub-program shown in FIG. 6.

FIG. 7 is a graph which illustrates the assignment of scan slots to an elevator car in two successive cycles of the program, and a traffic event which may occur between the assignment portions of two successive cycles of the program which results in degradation of service, using the strategy of the earlier filed copending applications. The example illustrated in FIG. 7 uses a 16 floor building, and reproduces the up and down assignment tables for an elevator car, which assignments are stored in RAMS 6 and 7 of FIGS. 3. It s assumed that the advanced floor position AVPO–AVP3, ie., the actual position of a stationary car, and the closest floor to the car at which the car could make a normal stop, for a moving car, is floor 9, and that the car is movin downwardly. It is assumed that sub-program LCD14 assigns down scan slots 08, 07 and 06 to the car a time $t_O$ in one cycling of the program. Depending upon the speed of the car, the spacing between the floors, and the cycle processing time, i.e., the time between successive assignments, it is highly probable that the advanced position of the elevator car will pass the slowdown point for at least one and possibly two or three of the floors associated with scan slots assigned to the car. It is assumed that the advanced position of the elevator car is at floor 7 (scan slot 06) at time $t_1$, just prior to the next assignment which is made in the next cycle of the program at time $t_3$, and that at time $t_2$ a down hall call is registered from one of the assigned scan slots associated with a floor at which the car can no longer make a normal stop, such as a down hall call from floor 9. At time $t_3$, when the next assignment is made, LCD6 would normally clear the assignment of scan slot 07 to the car, since it does not have a registered hall call, but it would not clear the assignment of down scan slot 08 because of the hall call which is associated therewith. This scan slot will not be assigned to another car, and the hall call will not be serviced until the elevator car makes almost a complete round trip.

Step 759 provides a powerful addition to the strategy of the earlier field copending applications while requiring very little additional instructions, and at the same time it removes processing time as a critical consideration. FIG. 8 is a graph which illustrates what is meant by the question "scan behind?" in step 759. For an up traveling car, if it is assumed that the advanced position of the car is at scan slot 08, the scan slots between the advanced position of the car and the lower terminal floor are behind the car. Thus, scan slots 00 through 07 are behind the car, and if the scan slot being considered is one of these, the scan loop is behind the car and the answer to step 759 would be yes. Scan 1 starts at the advanced position of th elevator car, slot 08, and proceeds to slot 15. Scan 2 starts at scan slot 15 and proceeds to scan slot 00. Scan 3 starts at scan slot 00 and proceeds through scan slot 07. Thus, the program may simply check to see if the scan loop is in scan 3. If it is, the answer to step 759 is yes; otherwise the answer is no. The example of FIG. 8 for a down traveling car assumes the advanced position of the car is at scan slot 03. Thus, the scan slots which are behind the car are those which start one above the advanced position of the car and extend to the uppermost terminal, ie., down scan slots 04 through 15 are behind the car. These scan slots would also be assigned in scan 3. If the advanced position of a car is at a terminal when an assignment is made, any scan slots assigned to the car having a hall call for the service direction towards the terminal which were assigned in a previous assignment cycle of the program will be scan 3 and thus cleared by step 759. A computer simulation of the universal strategy of the earlier filed copending applications, with and wthout step 759, using a processing cycle of 2.0 seconds and passenger traffic data from an actual elevator installation, resulted in step 759 reducing average waiting time from 30.0 seconds to 27.6 seconds, and reducing maximum waiting time from 229.8 to 131.2 seconds.

If the assignment scan is not behind the advanced position of the car, step 759 advances to step 760. Step 760 determines if $N_{HC1}$, the number of scan slots having hall calls assigned to this car from a 1 car set, is equal to or greater than $A_{CB}$. If it is not, step 762 increments $N_{HCl}$ and step 766 increments the floor count. If $N_{HCl}$ is equal to or greater than $A_{CB}$, step 764 clears the assignment of this scan slot to this car from the per car register, and step 766 increments the floor count. It will be noted that assignments cleard by step 764, as a result of either step 759 or 760, are not counted in step 762.

Step 768 checks to see if all of the scan slots in the present scan directon have been examined. If not, the program loops back to sep 756. If the present scan is completed, step 770 increments the scan number and changes the scan direction. Step 772 checks to see if the scan loop has been completed. If not, the program loops back to step 751.

If the loop is in the first scan when step 770 is reached, step 770 will increment the scan n count from 01 to 10 and step 751 loads that scan count to the temporary location. Step 753 will find bit location 0 equal to 0 and the program then advances to step 761 which initializes scan 2. Step 761 advances to step 756 and the program proceeds to step 770 when all scan slots of scan 2 have been processed. Step 770 increments the scan count from 10 to 11 and step 772 returns the program to step 751 which loads this scan count. Step 753 will find bit location 0 not equal to 0, and step 755 will find bit location 1 not equal to 0, and the program advances to step 763, which initializes scan 3, the scan which is behind the advanced floor position of the car. Step 763 may set a flag to be checked by step 759 to determine if an assigned scan slot with a hall call is behind the car. When the scan slots of scan 3 have all been processed, step 772 will indicate the scan loop has been completed, and the program advances to step 740 which increments the car count. When all cars have been processed, step 746 will advance to the exit terminal 748.

The new and improved special floor features and relative priorities between them, added to the universal strategy of the earlier filed copending applications, are implemented in the LCD13 which is function 346' of FIG. 5, and in LCD14, which is function 356' of FIG. 5. LCD13 will be described first, with FIGS. 9A and 9B, when placed in side-by-side relation, illustrating a new and improved sub-program for implementing the new special floor features.

It will be recalled from the discussion of FIG. 1 that the first special floor feature, which for purposes of example will be referred to as the main floor feature, is activated by a switch 75 which drives input terminal $\overline{PMNFL}$ of FIG. 4 true. The main floor may be selected to be any floor in the building, and may be changed, if desired. The binary address of the floor selected as the main floor is applied to terminals $\overline{PNMFL0}$ through $\overline{PMNFL3}$ of FIG. 4, such as by a plurality of switches 77, and to change the location of the main floor it is only necessary to change the position of switches 77 to apply the associated binary address of the new floor to these input terminals of FIG. 4. Switch 79 is set to provide a signal $\overline{PMFLD}$ which indicates the desired door position for a car selected by the first special strategy to park at the main floor, and swith 81 is set to indicate the service direction of the parked car, as well as to indicate which hall lantern should be energized when the car is parked with its doors open. For purposes of example, in describing LCD13, it will be assumed that the main floor feature is enabled by switch 75, and that the switches 77 are set to a valid floor address.

In like manner, the second special floor feature, which for purposes of example will be referred to as the convention floor feature, is activated by switch 83, shown in FIG. 1, the binary address of the selected floor is set by switches 85, the door mode is set by switch 87, and the car service direction and hall lantern selection is set by switch 89. For purposes of example, it is assumed that the second special floor strategy is enabled by switch 83, providing a true signal $\overline{PCONFL}$ for the input terminal with this same designation in FIG. 4, and that the switches 85 select a vaild floor binary address with signals $\overline{PCFL0}$-$\overline{PCFL3}$.

The first special strategy, when activated will attempt to maintain a quota of cars set by $Q_{MNF}$ in sub-program LCD12 by presenting dummy calls for the selected main floor, and it provides a NEXT car feature whereby a car is designated as the next car to leave the main floor in a selected direction, which car, according to the example, waits at the selected main floor, with its doors open or closed, as selected. If the door open mode is selected, the appropriate hall lantern will ben energized. A hall call at the floor for the selected service direction will open the car doors of a car parked at the floor with its doors closed, and then will answer a car call in the selected direction. A car call in a car parked at a floor with its doors open, will start the car if the call is in the direction indicated by the energized hall lantern.

The NEXT car is treated differently when assigning scan slots to the car, as will be hereinafter explained relative to sub-program to sub-program LCD14 which assigns scan slots.

The second special floor strategy, when activated, and there are no cars at the selected convention floor, places a dummy call to bring an idle car to the floor. A car parked at the selected convention floor will do so with its doors open or closed, as selected. If the doors are open, the selected hall lantern will be energized. A hall call at the convention floor in the selected service direction will open the doors of the car if it is parked with its doors closed, and a car call in the selected service direction will start the car. A car call in a car parked at the convention floor with its doors open will start the car if the car call is in the service direction selected by the hall lantern switch 89.

More specifically, sub-program LCD13 is entered at terminal 600, and step 602' initializes by clearing all dummy calls ($\overline{PKFL}$) and commands DOPN, SUT and SDT, by setting a word FLOOR in a index register of CPU 80 to the floor indicated by the binary address $\overline{PMNFL0}$-$\overline{PMNFL3}$, by setting a main floor flag to 1, which indicates the main floor feature is being processed, by setting the temporary word ASGN to the 4-bit word NEXT stored in the main memory of RAM 4, by setting the indicator FEATURE to indicate that the main floor feature is being run, in order to read the correct door and lantern features, and by loading the main floor features, set by switches 75, 79 and 81 of FIG. 1, and the wod AVAS from RAM O of FIG. 3 to temporary locations. Step 603 checks to see if the special floor feature under consideration is enabled, ie., in this instance it will check to see whether the main floor feature is enabled by noting the condition of switch 75 determined by the logic level of signal $\overline{PMNFL}$. If the main floor feature is not enabled signal $\overline{PMNFL}$ will be a logic 1, and the program proceeds to step 605 which checks the main flag by determining if it is equal to 1. At this point, the main flag is 1 and step 607 clears the word NEXT, as no car should be designated as the next car to leave the main floor, since the main floor feature is not enabled. The program advances to step 668 which again asks if the main floor flag is equal to 1. If it is, it indicates the second special floor feature has not yet been processed and step 670' initializes this feature by setting the word FLOOR to the address selected by switches 85 and indicated by signals $\overline{PCFLO}$–$\overline{PCFL3}$, by setting the main flag to 0, by setting the word ASGN to the 4-bit word CONV stored in the main memory of RAM 4, by setting the indicator FEATURE to indicate that the convention floor feature is being processed, and by loading the convention floor features, ie., by placing the signals indicative of the positions of switches 87 and 89 into a temporary storage location. The program then returns the step 603 to see if the convention floor feature is enabled. If signal $\overline{PCONFL}$ set by switch 83 is a logic 1, the convention floor feature is not enabled, step 605 finds the main flag to be 0, and advances to step 609 which clears the word CONV, as no car should have a convention floor assignment. Step 609 proceeds to step 668 which finds the main flag equal to 0 and advances to step 611. Step 611 checks to see which cars, if any, have main floor or convention floor assignments, and sets the bit of the word AVAS corresponding to these cars to zero, to indicate that they are not idle cars, but have a special floor assignment. In the running of sub-program LCD13 to this point, it has been assumed that neither special floor feature has been enabled. Thus, step 611 will not change the word AVAS, and the program exits at terminal 678.

If step 603 found that the main floor feature was enabled, step 613 determines if the binary address $\overline{PMNFL0}$–$\overline{PMNFL3}$ describes a floor which at last one elevator car is enabled to serve. If the address is not valid, ie., no cars can serve the selected floor, the program advances to step 605. If the address is valid, step 658 checks to see if the elevator system is in a peak traffic condition. This is determined in sub-program LCD12, function 344 of FIG. 5, which will be hereinafter described in detail when describing FIG. 11. If the system is in a traffic peak, the status character memory of RAM 0 shown in FIG. 3 will have a bit set in the word PEAKS to indicate the peak condition.

If the peak bit of PEAKS is set, step 664 checks the peak identifier bit in the same words PEAKS to find out whether the peak is an up peak or a down peak. If step 664 finds that it is not an up peak, then it must be a down peak and both special floor features are defeated during a down peak traffic condition. Thus, the program, for either the main or convention floor feature, during a down peak, will advance to step 605, words NEXT and CONV will be cleared, and the program will exit at terminal 678.

If the system is in an up peak, step 666 checks the main floor flag. If it is a zero, the program advances to step 605, as no convention floor assignments are made during an up peak. If the main floor flag is a one, step 667 checks to see if the dispatching direction for NEXT car at the main floor is up. If it is up, indicated by the voltage level of the lantern feature signal PMFLL, step 662 gives a dummy parking call PKFL to all cars which are enabled to serve the selected main floor. If the lantern feature for the selected main floor is not "up" the program advances to step 605. If step 658 finds no peak traffic condition, the program advances to step 612 which checks the word ASGN. The program also goes to step 612 from step 662 which gave all cars a dummy or parking call for the selected main floor. On this loop through step 612, the word ASGN is the word NEXT, set in step 602', no step 612 checks the word ASGN to see if there is a car designated as the next car to leave the main floor. If the word ASGN is zero, there is no car designated as the NEXT car to leave the main floor and the program advances to step 632. If there is a NEXT car, step 614 identifies the NEXT car. Step 615 checks to see if the car is in-service and not bypassing hall calls by checking the bit of the word INSV for the car identified. If the bit is a zero the car is not in-service or it is bypassing and the program advances to step 605. If the INSV bit is a 1, step 616 checks to see if the car is at the floor, which on this loop through the program is referring to the selected main floor since the main floor flag is a one. If the car is not at the main floor, step 618 assigns a dummy parking call $\overline{PKFL}$ to this car for the main floor and the program advances to step 668.

If the car is at the floor, step 624' checks to see if the car has a car call or a hall call in an assigned scan slot by testing the bit of the word $\overline{CALL}$ in RAM O associated with the car identified as NEXT. If this bit of $\overline{CALL}$ is a 0, indicaating the NEXT car has a call, step 620 checks to see which special floor feature is being run, and since it is the main floor feature, (main flag = 1), step 626 clears the assignment word NEXT to allow the car to serve the call. When the convention floor feature is being run, step 620 will advance to step 622 which clears the word CONV. If this bit of $\overline{CALL}$ is a 1, indicating no call, the program advances to step 621.

When the program reaches step 621, there is a car assigned to the special floor, it is located at the special floor and there is no call in an assigned scan slot which is ahead of the car in the service direction selected by the hall lantern feature, ie., switch 81 or switch 89 shown in FIG. 1 for the main and convention floor features, respectively. The program, starting with step 621 now determines if there is a call in an assigned scan slot which is behind the car.

More specifically, step 621 clears a direction flag, loads the position of the car into a temporary location, determines the scan slot address of the car position, and sets the floor count to the slot address. Step 623 checks the lantern feature for the special floor being considered on this pass. If the lantern feature indicates the car is set for up service, step 625 sets the direction flag to indicate the scan slots to be examined will be below the position of the car. If the landing feature indicates the car is set for down service, the direction flag is not set, which will indicate that the scan slots to be considered are those above the car position.

Step 627 loads the up hall call address for the scan slot of the car position (RAM 1 — FIG. 3). If the car is set for up travel there will be no hall call in this scan slot because the parked car set for up travel can see an up call at the floor and the program would not have reached this point. If the car is set for down travel, however, it would not see an up call at the floor. Step 629 determines if there is a hall call if the scan slot. If there is, step 631 checks to see if the scan slot is assigned to this car by checking the up assignment table in RAM 6 of FIG. 3. If the car is assigned to this scan slot, ie., not inhibited by the system control from seeing a hall call in this scan slot, step 633 changes the direction of the hall lantern. Step 635 checks the new hall lantern direction, just set in step 633, and if it is up, the command SUT for this car is set to a 1, to set the car for up travel which enables the car controller of the elevator car to see this hall call. If the new lantern direction is down, step 639 sets the command SDT to a 1, to set the car for down travel. From either step 637 or set 639 the program advances to step 668.

If step 629 finds no hall call in the up scan slot being examined, or if there is a hall call in the scan slot but the car is not assigned to this scan slot, step 641 asks if step 627 just checked for an up hall call. If the answer is yes, step 651 loads the down hall call address (RAM 1 — FIG. 3) for this same scan slot and the program returns to step 629 to check for a down hall call in this scan slot. If there is a hall call and the car is assigned to this down scan slot, steps 633, 635 and either step 637 or step 639 will enable the car to see this call. If there is no hall call in this down scan slot, or if there is a hall call but the car is not assigned this scan slot, step 641 will advance to step 643 which checks the direction flag. If step 625 set the direction flag to a one, step 645 decrements the scan slot count, as the program is examining scan slots below the car. If the direction flag is not a 1, step 643 goes to step 647 which increments the scan count, as the program is examining scan slots above the car.

Steps 645 and 647 both advance to step 649, which checks to see if all up and down scan slots behind the car have been examined. If not, the program returns to step 627 to examine the next scan slot for hall calls.

If the program reaches step 649 and step 649 finds all scan slots behind the car have been examined, the car with the special floor assignment is parked at the floor with no calls ahead or behind in assigned scan slots. In this situation, the door feature set by switch 79 or switch 87 of FIG. 1 is examined in step 653 to see if the car should be parked at this special floor with its doors open or closed. If the door feature determines that the car should be parked with closed doors, the program advances to step 688. If the door feature requests open doors, step 655 sets the command DOPN for this car to a 1, which command will open the car doors when it is output to the car, and step 635 examines the lantern direction set by switch 81 or switch 89. If the hall lantern direction is up, step 637 sets the command SUT to a 1, to set the car for up travel, and if the hall lantern direction is down, step 629 sets the command SDT to a 1 to set the car for down travel. The program then advances to step 668.

If step 612 finds the word ASGN is not greater than 0, no cars have an assignment for the special foor feature currently being processed and a suitable car must be found for the assignment. If steps 616 and 624' find a car at the special floor with the special floor assignment but it has a car call or a hall call in an assigned scan slot, another car must be found for the assignment. In either of these situations, the program advances to step 632. Step 632 initiates the portion of the program which locates the closest AVAS car to the special floor. If there is only one AVAS car and both special floor features are enabled, it will be assigned to the selected main floor due to the inherent priority this floor receives by running the main floor strategy prior to the convention floor strategy. Step 632 initializes the car count and sets a variable DIST to a number which is larger than the longest travel distance in the building. For example, with 16 floors, DIST may be set to 16.

Step 634 checks the AVAS bit for the first car in the car loop. If this car is not AVAS, the program advances to step 646 which increments the car number, and if the car loop has been completed, as tested by step 648, the assignment word NEXT or CONV is formed, depending upon which special floor strategy is running, and program advances to step 673 to check the assignment flag to determine if a valid assignment has been made.

If step 634 finds the car is AVAS, step 636 determines if the car is enabled to serve this floor by checking the floor enable in RAM 11. If the car is not enabled for this floor, the program advances to step 646. If the car is enabled, step 638 checks the bit of word NEXT associated with this car, to see if it has been given the NEXT assignment. If it has, the program advances to step 646. If it is not NEXT, step 640 determines the distance from the car to the floor in question by obtaining the absolute difference between the numbers of the floors. Step 642 checks to see is this distance is closer than DIST, and since this is the first AVAS car found it will be closer than DIST, since DIST was arbitrarily set to a number larger than the longest travel distance. Step 644 loads the car number into a temporary location and changes the word DIST to the distance from this car to the floor in question.

Step 646 increments the car number and 648 determines if all the cars have been processed. If not, the program loops back to step 634. When all cars have been processed, the car number stored in the temporary location is the closest AVAS car to the floor in question, and step 671 forms the assignment word NEXT, or CONV, depending upon which loop the program is in. From step 671 the program advances to 673 which checks the assignment flag. If it is not set, no car was found and the assignment word NEXT or CONV is cleared in step 675, depending upon which strategy is active, and the program advances to step 668. If the assignment flag is a one, indicating a suitable car has been found for the special floor assignment, step 652 checks to see which special floor strategy is being considered. If it is the main floor strategy, step 654 loads the assignment word into the location for word NEXT in RAM 4, and if it is the convention floor, step 656 loads the assignment word CONV into the location for this word in RAM 4. The program then returns to step 612 which results in a dummy call being given to the selected car in step 618, and the program advances to step 668. Step 668 checks to see if both special floor features have been run. If they have not, the program advances to step 670' which initiates the program for running the strategy for the convention floor. If both features have been run, step 611 removes the AVAS bit from the cars which were given the NEXT and CONV assignments, and the program exits at terminal 678.

FIGS. 10A and 10B may be assembled to provide a flow chart of a sub-program LCD14 which may be used for function 356' shown in FIG. 5, which function assigns scan slots to the cars, it continues the special floor features initiated in LCD13, and it implements the improvement to the universal strategy when a traffic peak exists. The scan slots are assigned to the cars in three passes for each set, with each pass processing all of the sets before starting the next pass. The sets are handled in the order of increasing number of cars per set, and the selection of cars to be scanned in each set is the order determined in LCD8.

Sub-program LCD14 is entered at terminal 890, step 892' loads the car calls from RAM 3 to the main memories of the per car registers (RAMS 12–15), and initializes the assignment pass count, to start with assignment pass 1. Step 896 initializes the set count so the sets are taken in the order of increasing number of cars per set. As hereinbefore stated, the set numbers are binary numbers produced in the up and down masks, RAMS 10 and 9, respectively, by logic ones in each row associated with a floor level for each car enabled to serve the floor level. If the car is not enabled, its bit location for the floor has a logic zero. Step 898 calls the first set to be considered with a fetch instruction which accesses a look-up table in control memory 82 of FIG. 2. A binary counter set to count from 4 through 15 will call up to 12 sets, with this counter being incremented to call the next set. Sub-program LCD5 already made the assignments to the 1 car sets, which reduces the maximum number of sets to be considered in LCD14 from 16 to 12.

Step 900 checks to see if the set called is a valid set, since all possible multiple car set numbers will be examined. This is accomplished by checking to see if $A_{SI}$, the average number of scan slots in the set per inservice car enabled for the set, is zero. If so, it is an invalid set and the program advances to step 978 to advance the set count. If it is a valid set, $A_{SI}$ will be non-zero and step 901 initializes the floor or scan slot count. Step 903 loads the up mask for this set to the main memory of the per car registers (RAMS 12–15). The up mask for the set exposes the up scan slots associated with floors of the set, ie., a logic 1 is located at each scan slot of the set corresponding to each car which can serve the set, and all other bit locations will be a logic 0. Step 905 checks to see if the floor being considered is in the set. If it is not, step 907 clears the mask word and step 909 loads it into the per car registers (RAMS 12–15). If the floor is in the set, the mask word is located to the per car registers by step 909. Step 911 checks to see if the down mask word for this scan slot has been checked. If the up mask word was just checked, step 913 loads the down mask address for this slot and returns the program to step 905. When both the up and down masks for this scan slot have been examined, step 915 increments the floor or scan count. Step 917 checks to see if all scan slots have been considered, and if they have not, the program returns to step 903. When all scan slots have been considered, the up and down masks for the set being considered are in the per car registers.

The program then advances to step 919 which initializes the car count and loads the scan slot location of the car to a temporary location. Step 921 clears an indicator NXCV used to indicate when a car has a special floor assignment, and it loads the words INSV and UPSCAN from RAM 0 to a temporary location. Step 906 checks the INSV bit for the first car considered, and if the car is not in-service, the program advances to step 974, which increments the car count. If the car is in-service, step 908 checks to see if the car is enabled for this set. If it is not, the mask in the per car register will have a zero for this car, and the program advances to step 974.

If the car is in the set, the program starts the first assignment pass with step 901. Step 910 checks to see if this car has been given the NEXT assignment. If it has, step 923 checks the lantern direction selected by switch 81 of FIG. 1 and step 925 loads the location of the main floor selected by switches 77 in FIG. 1. Step 931 assigns an up or a down scan slot at the selected main floor to this car, depending upon which; lantern direction has been selected, it sets indicator NXCV for this car to a 1, and the program advances to step 916. Step 916 checks the word AVAS to see if there are any idle cars. If the work AVAS is not zero, a car with a special floor assignment is not given any further scan slot assignments and the program advances to step 974, which increments the car count and shifts the words INSV and UPSCAN. If there are no idle cars, a car with a special floor assignment will receive additional scan slot assignments and the program advances to step 926.

If step 910 finds that the car does not have a NEXT assignment, step 922 determines if the car has a CONV assignment. If it does, step 927 checks the lantern feature selected by switch 89 of FIG. 1 and step 929 loads the position of the convention floor as selected by switches 85 of FIG. 1. Step 931 assigns the scan slot to this car associated with the selected floor and service direction, and advances to step 916.

If the car does not have a NEXT or CONV assignment, step 918 checks the AVAS bit for this car. If the car is not idle, the program advances to step 926. If the car is idle, step 933 checks the up mask for this car, for the floor at which the car is parked, in the per car register and if the up mask is a 1, indicating the car can serve the up direction from this floor, step 935 assigns this up scan slot to this car. If it is not enabled to serve the up service direction from this floor, step 933 advances to step 937 which checks to see if the car can serve down direction from this floor. If it can, step 939 assigns the down scan slot related to the floor of the car and the program advances to step 926. If the car is not so enabled, step 937 advances directly to step 926. Thus, an AVAS car will receive both the up and down scan slots associated with the floor at which it is located, if the car is able to serve both service directions from this floor.

Step 926 initializes the scan count and clears the variables $N_{DIST}$, $N_{SI}$ and $N_{CI}$. The scan counts, relative to the three scans, scan 1, scan 2 and scan 3, were hereinbefore described relative to LCD6 (FIG. 6). The variable $N_{DIST}$ is used to count the valid scan slots the counting and assignment sequence has progressed from the car, so far in the assignment routine. The variable $N_{SI}$ is used to count the number of scan slots assigned to the car so far in the set being considered. The variable $N_{CI}$ is used to count the number of hall calls assigned to a car so far in the set being considered.

Step 928 determines the parameters for the scan, ie., the number to be subtracted from the floor level of the car for an up or down traveling car so the slot address may be determined. Steps 941 and 943 determine if the new and improved feature related to improving service during a traffic peak, such as a down peak, should be implemented. A down peak is used to describe the new feature for improving service during a traffic peak because this is the preferred embodiment, but the feature may be applied to up peak if desired. Step 941 checks to see if there is a traffic peak by checking the word PEAKS in RAM 0, and if there is, it determines whether it is a down peak. If there is no down peak, step 941 advances to step 963. If there is a down peak, step 943 checks to see if up scan slots are to be assigned, which can be determined from the scan parameters of step 928. If up scan slots are not going to be assigned during the next assignment of scan slots, step 963 clears a flag DP and the program advances to step 930. If up scan slots are to be assigned, step 945 sets the flag DP to indicate that the system is in a down peak and that up scan slots are the next scan slots to be assigned. Step 945 advances to step 930.

Step 930 subtracts the parameter determined in step 928 from the floor level of the car to determine the slot address of the car. The three slot addresses for an up traveling car, which start the scans for scanning ahead of the car, scanning in the direction opposite to the car travel direction, and scanning behind the car, are $N_{CP-1}$, $\overline{N_{CP-1}}$ and $N_{CP} - \overline{N_{POS+1}}$ respectively, where $N_{CP}$ is a counter initialized such that the count will be 15 when the counter is incremented by one for each floor from the car position to the terminal in the direction of the scan, and $N_{POS}$ is the scan slot number which corresponds to the position of the car. The three scan slot addresses for a down traveling car, which start the scans for scanning ahead of the car, scanning in the direction opposite to the car travel direction, and scanning behind the car, are $\overline{N_{CP-1}}$, $N_{CP-1}$ and $\overline{N_{CP}-(N_{POS+1})}$.

The program assigns scan slots to AVAS cars without limitation as to the travel distance from the car to the floor associated with the assigned scan slot. The program does, however, restrict the assignment of scan slots to the busy cars, based on the travel distance from the car to the floor and service direction of the scan slot, using the present travel direction of the car rather than the physical separation of the car from floor associated with the scan slot. For example, in a 16 floor building an up traveling car at the 3rd floor is the equivalent of 27 floors from a down call at the second floor while the physical separation is 1 floor. For purposes of example the distance limitation applied to the assigning of scan slots is one-half of a round trip for a car. This is conveniently figured by subtracting the level of the lowest floor the car is enabled to serve from the highest.

More specifically, the program advances from step 930 to step 934 which determines if the scan slot is enabled by checking the set mask. Step 936 checks the AVAS bit for the car in RAM 0. If the car is not idle, step 947 checks indicator NXCV to see if the car has a NEXT or CONV assignment. If it is not AVAS and does not have a special floor assignment, step 938 checks to see if the assignment loop has progressed the predetermined travel distance from the location of the car. Except in certain circumstances, $N_{DIST}$ is incremented each time the assignment loop considers a scan slot, and when $N_{DIST}$ reaches the predetermined travel distance limitation, the car is not assigned any further scan slots. When the travel distance limitation is met for a car, step 938 advances to step 974. The travel distance limitation is not applied to AVAS, NEXT or CONV cars, and if steps 936 or 947 find these conditions, they bypass the travel distance limit step 938, proceeding directly to step 940.

If step 938 finds $N_{DIST}$ is equal to or less than the travel distance limitation, step 949 checks to see if the flag DP is set. If it is not set, step 932 increments $N_{DIST}$. If the flag DP is set, step 932 is bypassed, and $N_{DIST}$ is not incremented. Thus, during a down peak traffic condition the progression through up scan slots of the assignment loop are not counted against the travel distance limitation of a busy car, allowing the car to receive down scan slot assignments which are beyond the travel distance limitation and to thus allow the car to participate in the down peak traffic.

Step 940 checks to see if the scan slot has already been assigned. If it has, the program advances to step 966, which increments the slot count. If the scan slot has not been assigned, step 942 determines if this is the first pass. If it is, step 944 checks to see if the car has a registered car call for this scan slot. If it does not, the program advances to step 966, to increment the slot count. If the assignment routine is in the first pass and the car has a car call for the scan slot, or if the assignment routine is not in the first pass, the program advances to step 946, which checks to see if there is a registered hall call for the scan slot. If there is, step 948 determines if $N_{HCT}$, the total number of hall calls assigned to this car so far, plus one, is less than or equal to $A_{CB}$, the hall call average per car in the building. If $N_{HCT}$ plus one is greater than $A_{CB}$, the program advances to step 966. If $N_{HCT}$ plus one is equal to or less than $A_{CB}$, step 950 checks to see if the scan is in the third pass. If it is not, step 952 checks to see if $N_{CI}$ plus one is less than or equal to $A_{CI}$, where $N_{CI}$ is the number of hall calls assigned to the car so far in the set being considered, and $A_{CI}$ is the average number of calls per in-service car for the set being considered. If $N_{CI}$ plus one is greater than $A_{CI}$, the program advances to step 966. If $N_{CI}$ plus one is equal to or less than $A_{CI}$, the program advances to step 954. If step 950 determines the assignment is in the third pass, the limitation of step 952 is skipped, and the program goes directly to step 954. Step 954 increments $N_{CI}$ and $N_{HCT}$ and advances to step 964 which assigns the scan slot to the car.

After the scan slot is assigned to the car by step 964, the flag DP is checked in step 951 to determine if $N_{SI}$ and $N_{SS}$ should be incremented. If the flag DP is not set, $N_{SI}$ and $N_{SS}$ are incremented by step 962. If the flag DP is set, indicating up scan slots are being assigned during a down peak traffic condition, step 962 is skipped and step 951 proceeds directly to step 966. Thus, up scan slot assignments during a down peak do not affect $N_{SI}$, the total number of scan slots assigned to the car from the set being considered, or $N_{SS}$, the total number of scan slots assigned to the car from all sets, and the car thus may be assigned down scan slots, enabling the car to participate in down peak traffic.

If step 946 determines there is no hall call in the slot, the program advances to step 956. Step 956 checks to see if the assignment is in the third pass. If it is not, the program advances to step 958 which determines if $N_{SI}$ plus one is equal to or less than $A_{SI}$. The variable $N_{SI}$ is the number of scan slots assigned to the car so far from the set being considered, and $A_{SI}$ is the average number of scan slots per in-service car for the set being considered. If $N_{SI}$ plus one is greater than $A_{SI}$, the program advances to step 966. If $N_{SI}$ plus one is equal to or less than $A_{SI}$, step 960 checks to see if $N_{SS}$ plus one is less than or equal to $A_{SB}$. The variable $N_{SS}$ is equal to the total number of scan slots assigned to the car so far, and $A_{SB}$ is the average number of scan slots per in-service car for the building. If $N_{SS}$ plus one is greater than $A_{SB}$ the program advances to step 966. If it is equal to, or less than $A_{SB}$, the program advances to step 964 which assigns the scan slot to the car. If step 956 finds that the assignment is in the third pass, the limitations of steps 958 and 960 are skipped, and the program advances directly to step 964.

The down peak modification added by step 951 modifies the effect of the limiting averages $A_{SI}$ and $A_{SB}$ in steps 958 and 960, respectively. This modification, along with the modification in step 949 which affects the travel distance limitations, permits a car to have more scan slot assignments than it would normally be allowed, and it may thus receive down scan slot assignments during a down peak traffic condition. Since there would normally be little or no traffic associated with the up scan slot assignments during a down peak, the car will quickly assist other cars with the down peak traffic.

A computer simulation of the universal strategy of the copending applications, with and without the new down peak modification added by steps 949 and 951 illustrates the improved down peak average waiting time for hall calls resulting from the modification. The computer simulation was conducted using a building having four cars and nine floors with a down peak traffic density of 20.6% of the building population each 5 minutes. The average and maximum waiting times for hall calls away from the main floor are listed below, with the new down peak feature, and without the new down peak feature:

| | Without Down Peak Feature | With Down Peak Feature |
|---|---|---|
| Average wait time away from main floor | 25.0 seconds | 16.9 seconds |
| Maximum wait time away from main floor | 120.6 seconds | 78.9 seconds |

The program next advances to step 966, which increments the scan slot count. Step 968 checks to see if the scan number has been completed. If it has not, the program loops back to step 930. If all the scan slots associated with the scan number have been completed, step 953 determines if this is the first pass. If it is, the program advances to step 974, as only scan slots in the direction of car travel are assigned during the first pass. Thus, scan slots for which the car has a car call are only assigned to the car if they are ahead of the car, in the travel direction of the car. If it is not the first pass, the program advances to step 970 which increments the scan count, and changes the scan direction. Step 972 checks to see if all three phases (scan 1, scan 2 and scan 3) of the scan count have been completed. If the scan count hasn't been completed, the program loops back to step 928. If the scan count has been completed, the program advances to step 974 which increments the car count and shifts the UPSCAN and INSV words to expose the bits associated with the next car to be considered. Step 976 determines if the car count has been completed. If it has not, the program loops back to step 921. If it has been completed, the program advances to step 978 which increments the set count, to call the next set. Step 980 checks to see if all of the sets have been considered. If not, the program loops back to step 898. If all sets have been considered, the program advances to step 982 which increments the assignment pass count. Step 984 checks to see if the pass loop has been completed. If not, the program loops back to step 896. If the pass loop has been completed, the program exits at terminal 986.

FIG. 11 is a flow chart of a sub-program LCD12 which may be used for the block function 344 of FIG. 5, related to special traffic features. Sub-program LCD12 shown in FIG. 11 is the same as sub-program LCD12 shown in FIG. 16 of the earlier filed copending applications. It is included in this application since certain of the modifications to the strategy relate to the setting of peak traffic indicators. Sub-program LCD12 detects predetermined traffic conditions, and in response thereto takes a predetermined course of action. For example, a peak traffic condition in the down direction may be detected by a car above the main floor, set for down travel, bypassing hall calls. This may be detected by checking the 4-bit word BYPS stored in row 07 of RAM 0. A peak traffic condition in the up direction may be detected by a loaded car leaving the main floor. It may also be detected by a car at the main floor, set for up travel, set to bypass hall calls. Again, the 4-bit word BYPS may be checked.

If both the up peak and down peak events occur simultaneously, the down peak takes precedence.

The predetermined course of action taken by sub-program LCD12 in response to a peak condition determines the quota of cars to be maintained at the main floor, $Q_{MFL}$, and actuates a peak timer. The peak timer maintains the peak related strategy for a predetermined period of time after the occurrence of each event which is used to indicate the peak is occurring.

More specifically, sub-program LCD12 is entered at terminal 560 and step 562 checks input signal $\overline{IN5}$ of CPU 80 to determine if the main floor feature is true, indicated by a true signal $\overline{PMNFL}$ (FIGS. 1 and 4), which may be controlled by switch 75. If the main floor feature is not active, the program advances to step 592. If the main floor feature is active, step 564 checks the 4-bit word BYPS stored in RAM 0 to see if any car is bypassing hall calls. As hereinbefore stated, this test may be used to detect peaks for both traffic directions. If the word BYPS is zero, the program advances to step 592. If the word BYPS is not all zeros, step 566 initializes the car count and step 568 checks the first bit of word INSC, stored in RAM O, which bit is associated with car 0. If this bit is zero, indicating this car is not in-service with the system control 22, the program advances to step 588. If the car is in-service, step 570 checks the bit of word BYPS, stored in RAM 0, associated with car 0. If this bit is zero, the car is not bypassing and the program advances to step 588. If the BYPS bit is a 1, the car is bypassing and step 572 determines if the bypassing is associated with up or down traffic by checking to see if the car is at the main floor. If the car is at the main floor, step 574 checks the bit of word UPTR, stored in RAM 0, to see if the car is set for up travel. If it is not, the program advances to step 588. If it is, step 576 sets a peak bit in the status character memory of RAM 0, it sets a peak identifier bit in the same RAM to indicate up peak, it sets the quota of cars to be maintained at the main floor ($A_{MNF}$), to some predetermined number, such as 2 for a 4 car bank, and it sets a flag to indicate the up peak bit has been set. Step 578 sets a peak timer, which will keep the system on up peak for a predetermined period of time.

If step 572 found that the bypassing car was not at the main floor, step 580 checks to see if the car is above the main floor. If it is not, the program advances to step 588. If the car is above the main floor, its travel direction is checked in step 582 by checking the bit of word UPTR stored in RAM 0 associated with this car. If the car is set for up travel the bit will be a 1, and the program advances to step 588. If the car is set for down travel, the UPTR bit will be a zero and step 584 sets the bits in the status character memory of RAM 0 to indicate a down peak, the main floor quota $Q_{MNF}$ is set to some predetermined number, such as zero for a 4 car bank, and it clears a flag to indicate the down peak bit has been set.

If either the up peak or down peak bit is set, the program reaches step 578 which sets the peak timer, and step 586 checks the flag to see if the system has been set for up or down peak. If the flag is zero, indicating a down peak, no further cars need by checked, since down peak takes precedence over peak. If the flag is a one, indicating an up peak, the remaining cars must be checked to determine if any will trigger the down peak feature, since down peak takes precedence. If step 586 finds the flag is set, step 588 increments the car count and the words BYPS, INSC and UPTR are shifted to look at the bits of these words which are associated with the new car. Step 590 checks to see if all cars have been considered, and if not, the program loops back to step 568.

When step 590 finds that all of the cars have been considered, or as soon as the down peak is activated, or if PMNFL or the word BYPS was zero, step 592 is reached which checks the peak timer. If the peak timer is active, the program exits at terminal 596. If the peak timer has timed out, step 594 resets the peak bit in the status character memory of RAM 0, and sets the main floor quota, $Q_{MNF}$ to some predetermined number, such as 1 for a 4 car bank, and then the program exits at terminal 596.

I claim as my invention:

1. A method of controlling a plurality of elevator cars to provide service for a plurality of floors of a building, comprising the steps of:

providing means for registering up and down hall calls from at least certain of the floors of the building, assigning the various up and down service directions of the floors by dividing them among all of the in-service elevator cars according to a predetermined strategy, periodically clearing those assigned up and down service directions of the floors which do not have a registered hall call associated therewith, and also an assigned up or down service direction of a floor which has a hall call associated therewith which is located behind the advanced position of the elevator car it is assigned to, and reassigning the up and down service directions from the floors cleared in the clearing step, by dividing them among all of the in-service elevator cars according to the predetermined strategy.

2. A method of controlling a plurality of elevator cars to provide service for a plurality of floors of a building, comprising the steps of:

providing means for registering up and down hall calls from at least certain of the floors of the building, assigning the various up and down service directions of the floors by dividing them among the elevator cars according to a predetermined strategy, said predetermined strategy including the step of providing a building call average per elevator car responsive to the number of registered hall calls and the number of elevator cars, periodically clearing those assigned up and down service directions of the floors which do not have a registered hall call associated therewith, and also an assigned up or down service direction of a floor which has a hall call associated therewith which is located behind the advanced position of the elevator car it is assigned to, and reassigning the up and down service directions from the floors cleared in the clearing step, by dividing them among the elevator cars according to the predetermined strategy, said assigning and reassigning steps assigning up and down service directions from the floors to the elevator cars such that the number of hall calls associated therewith does not exceed the building call average for any elevator car.

3. A method of controlling a plurality of elevator cars to provide service for a plurality of floors of a building, comprising the steps of:

providing means for registering up and down hall calls from at least certain of the floors of the building, assigning the various up and down service directions of the floors by dividing them among the elevator cars according to a predetermined strategy, said predetermined strategy including the steps of providing a building call average per elevator car responsive to the number of registered hall calls and the number of elevator cars, and providing a building floor average per elevator car responsive to the number of floors and up and down service directions therefrom, and the number of elevator cars, periodically clearing those assigned up and down service directions of the floors which do not have a registered hall call associated therewith, and also an assigned up or down service direction of a floor which has a hall call associated therewith which is located behind the advanced position of the elevator car it is assigned to, and reassigning the up and down service directions from the floors cleared in the clearing step, by dividing them among the elevator cars according to the predetermined strategy, said assigning and reassigning steps assigning up and down service directions from the floors to the elevator cars such that the number of such assigmments to any one car does not exceed the building floor average, and the number of hall calls associated therewith does not exceed the building call average.

4. A method of controlling a plurality of elevator cars to provide service for a plurality of floors of a building, comprising the steps of:

providing means for registering up and down hall calls from at least certain of the floors of the building, dividing the up and down service directions of the floors into sets served by the same combination of elevator cars, assigning the various up and down service directions of the floors by dividing them among the elevator cars according to a predetermined strategy, said predetermined strategy including the steps of providing a building call average per elevator car responsive to the number of registered hall calls and the number of elevator cars, and providing a set call average per elevator car for each set served by more than one elevator car responsive to the number of registered hall calls in the set and the number of elevator cars serving the set, periodically clearing those assigned up and down service directions of the floors which do not have a registered hall call associated therewith, and also an assigned up or down service direction of a floor which has a hall call associated therewith which is located behind the advanced position of the elevator car it is assigned to, and reassigning the up and down service directions from the floors cleared in the clearing step, by dividing them among the elevator cars according to the predetermined strategy, said assigning and reassinging steps assigning up and down service directions from the floors to the elevator cars such that the number of hall calls associated therewith does not exceed the building call average for any elevator car, and the number of hall calls assigned to an elevator car from any set does not exceed the set call average of the set.

5. The method of claim 4 including the steps of providing a building floor average per car responsive to the number of floors and up and down service direction therefrom, and the number of elevator cars, and providing a set floor average per car for each of the sets served by more than one elevator car responsive to the number of floors and up and down service directions therefrom in a set, and the number of cars serving the set, with the assigning and reassigning steps assigning the up and down service directions from the floors such that the total number of such assignments for any one elevator car does not exceed the building floor average, and the number of such assignments from each set to any one elevator car does not exceed the set floor average for the set.

6. The elevator system for a building having a plurality of floors, comprising:

a plurality of elevator cars, means mounting said plurality of elevator cars for movement relative to the floors, up and down hall call registering means for registering hall calls for elevator service in the up and down directions, respectively, from at least certain of the floors, first means assigning the up and down service direction from the floors to all of the in service elevator cars according to a predetermined strategy, and second means periodically clearing the assignments of those up and down service directions from the floors which do not have a registered hall call associated therewith, and those which have a registered hall call which are behind the advanced position of the elevator car they are assigned to, said first means reassigning those up and down service directions from the floors cleared by said second means, according to the predetermined strategy.

7. An elevator system for a building having a plurality of floors, comprising:

a plurality of elevator cars, means mounting said plurality of elevator cars for movement relative to the floors, up and down hall call registering means for registering hall calls for elevator service in the up and down directions, respectively, from at least certain of the floors, means providing a building call average per elevator car responsive to the number of registered hall calls and the number of elevator cars, first means assigning the up and down service directions from the floors to the elevator cars according to a predetermined strategy which includes making the assignments such that the number of hall calls associated therewith does not exceed the building call average for any elevator car, and second means periodically clearing the assignments of those up and down service directions from the floors which do not have a registered hall call associated therewith, and those which have a registered hall call which are behind the advanced position of the elevator car they are assigned to, said first means reassigning those up and down service directions from the floors cleared by said second means, according to the predetermined strategy.

8. The elevator system of claim 7 including means providing a building floor average per elevator car responsive to the number of up and down service directions from the various floors and the number of elevator cars, with the first means assigning the up and down service directions from the floors such that the number of such assignments to any one elevator car does not exceed the building floor average.

9. An elevator system for a building having a plurality of floors, comprising:

a plurality of elevator cars, means mounting said plurality of elevator cars for movement relative to the floors, up and down hall call registering means for registering hall calls for elevator service in the up and down directions, respectively, from at least certain of the floors, means dividing the up and down service directions of the floors into sets served by the same combination of elevator cars, means providing a building call average per elevator can responsive to the number of registered hall calls and the number of elevator cars, means providing a set call average per elevator car for each set responsive to the number of registered hall calls in the set and the number of elevator cars serving the set, first means assigning up and down service directions from the floors to the elevator cars according to a predetermined strategy which includes making the assignments such that the number of hall calls associated therewith does not exceed the building call average for any elevator car, and the number of hall calls assigned to an elevator car from any set does not exceed the set call average of the set, and second means periodically clearing the assignments of those up and down service directions from the floors which do not have a registered hall call associated therewith, and those which have a registered hall call which are behind the advanced position of the elevator car they are assigned to, said first means reassigning those up and down service directions from the floors cleared by said second means, according to the predetermined strategy.

10. The elevator system of claim 9 including means providing a building floor average per car responsive to the number of floors and up and down service directions therefrom, and the number of elevator cars, and means providing a set floor average per car for each of the sets served by more than one elevator car responsive to the number of floors and up and down service directions therefrom in a set, and the number of cars serving the set, with the first means assigning the up and down service directions from the floors such that the total number of such assignments to any one elevator car does not exceed the building floor average, and the number of such assignments from each set to any one elevator car does not exceed the set floor average for the set.

11. An elevator system for a structure having a plurality of landings, comprising:

a plurality of elevator cars, first means mounting said plurality of elevator cars for movement relative to the landings, second means for registering calls for elevator service for the up and down service directions of the plurality of landings, third means periodically providing a first limiting average responsive to the current status of a predetermined parameter of the elevator system, fourth means periodically assigning the up and down service directions from the landings to all of the in service elevator cars by dividing them among the elevator cars within predetermined constraints which include said first limiting average, and fifth means periodically clearing the assignments of those up and down service directions from the landings which do not have a registered hall call, and those which have a registered hall call but which are behind the advanced position of the elevator car they are assigned to, said fourth means reassinging those up and down service directions from the floors cleared by said fifth means.

* * * * *